US007080683B2

(12) United States Patent
Bhatti et al.

(10) Patent No.: US 7,080,683 B2
(45) Date of Patent: Jul. 25, 2006

(54) FLAT TUBE EVAPORATOR WITH ENHANCED REFRIGERANT FLOW PASSAGES

(75) Inventors: Mohinder Singh Bhatti, Amherst, NY (US); Shrikant Mukund Joshi, WIlliamsville, NY (US); Sunil S. Mehendale, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 88 days.

(21) Appl. No.: 10/866,905

(22) Filed: Jun. 14, 2004

(65) Prior Publication Data

US 2005/0274506 A1 Dec. 15, 2005

(51) Int. Cl.
*F28F 1/42* (2006.01)

(52) U.S. Cl. ..... 165/179; 165/177; 165/173

(58) Field of Classification Search ..... 165/166, 165/167, 172–174, 176, 179, 133, 177
See application file for complete search history.

(56) References Cited

U.S. PATENT DOCUMENTS

| | | | | |
|---|---|---|---|---|
| 2,018,163 | A * | 10/1935 | Wells | 165/147 |
| 4,470,455 | A | 9/1984 | Sacca | 165/167 |
| 4,515,149 | A * | 5/1985 | Sgroi et al. | 126/651 |
| 4,535,839 | A | 8/1985 | Sacca | 165/153 |
| 5,318,114 | A | 6/1994 | Sasaki | 165/176 |
| 6,000,467 | A * | 12/1999 | Tokizaki et al. | 165/134.1 |
| 6,161,616 | A * | 12/2000 | Haussmann | 165/176 |
| 6,357,522 | B1 * | 3/2002 | Dienhart et al. | 165/183 |
| 6,449,979 | B1 * | 9/2002 | Nagasawa et al. | 62/503 |
| 6,907,922 | B1 * | 6/2005 | Katoh et al. | 165/177 |
| 2004/0112572 | A1 * | 6/2004 | Moon et al. | 165/104.21 |
| 2005/0172664 | A1 * | 8/2005 | Cho et al. | 62/515 |

FOREIGN PATENT DOCUMENTS

JP 11-159985 * 6/1999

OTHER PUBLICATIONS

Derwent Acc No. 1997-524532, Method of obtaining optimal hydraulic diameters for automobile heat exchangers, RD 402008A, Anonymous, Pub. Oct. 10, 1997.*

* cited by examiner

*Primary Examiner*—Teresa J. Walberg
(74) *Attorney, Agent, or Firm*—Patrick M. Griffin

(57) ABSTRACT

A heat exchanger for a heating, ventilating and air conditioning system comprises a plurality of heat exchange tubes extending between a pair of spaced header tanks and arranged in groups of tubes with varying number of tubes in each group to cause a refrigerant to flow in multiple passes in the interior of the tubes across another fluid flowing on the exterior of the tubes. The heat exchange tubes comprise a plurality of flow passages having at least one corner formed by a pair of straight or arcuate sides with an included angle of less than or equal to ninety degrees, more preferably less than or equal to thirty degrees, to promote intense pool boiling within the flow passages. In addition to at least one corner region, the flow passage has a passage-specific optimal hydraulic diameter determined by the relationship between the optimal hydraulic diameter of the passage and the optimal hydraulic diameter of a baseline circular passage.

19 Claims, 15 Drawing Sheets

FIG - 1
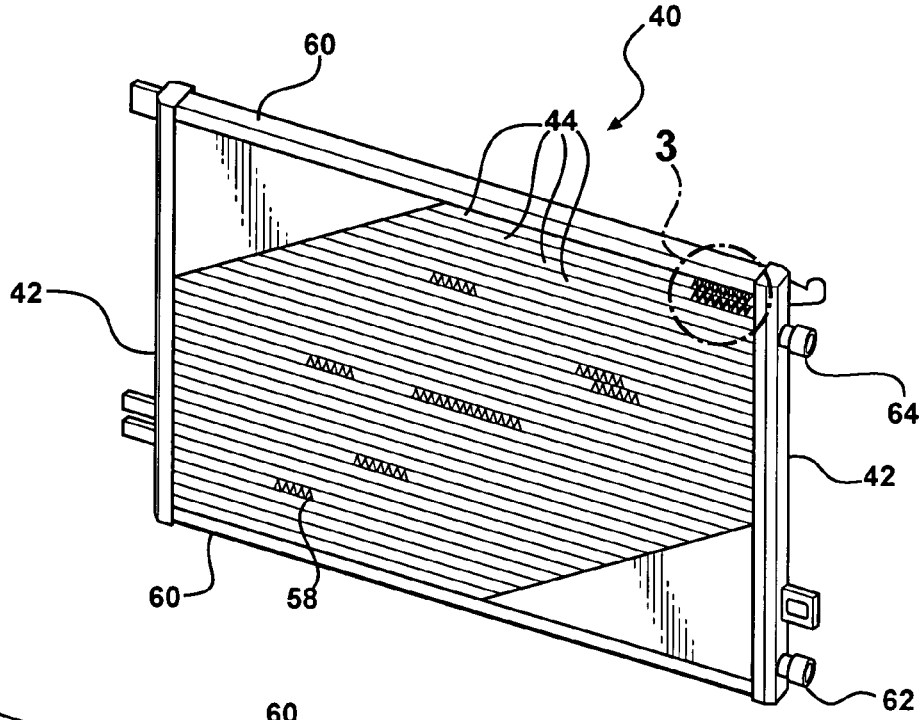
FIG - 2
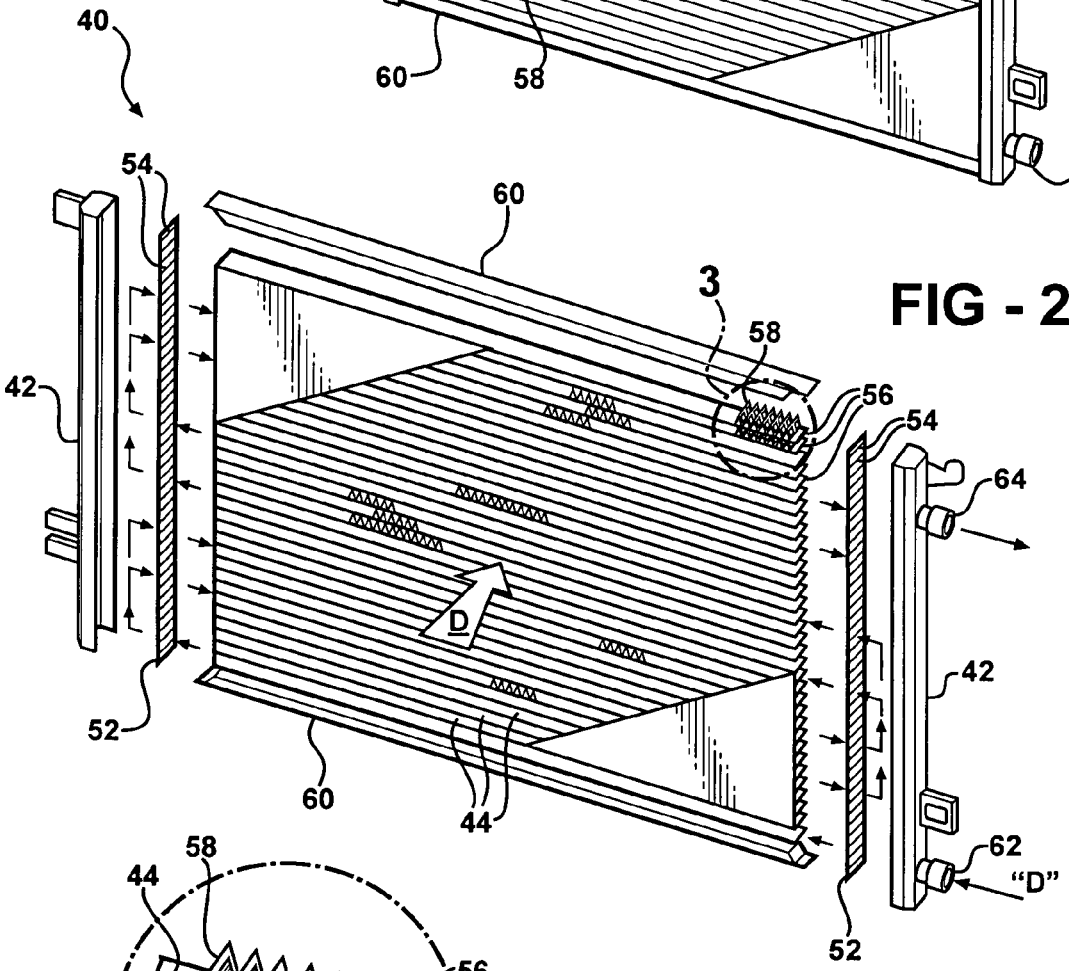
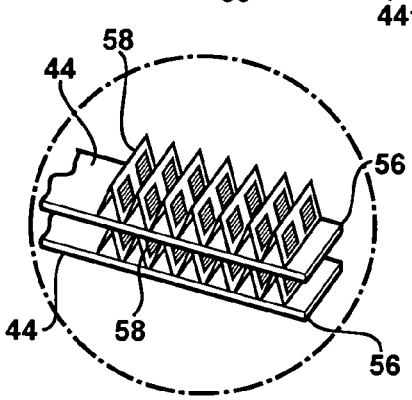
FIG - 3

FLAT TUBE EVAPORATOR WITH ENHANCED REFRIGERANT FLOW PASSAGES

BACKGROUND OF THE INVENTION

1. Field of the Invention

The subject invention relates to heat exchangers, and more specifically to an evaporator, that utilizes flat tubes having a plurality of flow passages extending therethrough.

2. Description of the Related Art

Evaporators for automobile heating, ventilation and air conditioning (HVAC) systems are well known in the art as described in the U.S. Pat. Nos. 4,470,455 and 4,535,839. Such evaporators typically include a core formed by a plurality of tubes between which fins are disposed for permitting ambient air to flow across the exterior of the tubes. The tubes are in fluid communication with spaced tanks to allow refrigerant—working fluid of the system capable of undergoing transformation from liquid to vapor and vice versa—to flow from one tank to the other through the tubes. This permits heat exchange between the refrigerant and the ambient air as the refrigerant flows through the tubes.

Various evaporator tubes exist in the art. For example, a laminated tube is fabricated by joining a pair of embossed plates together to create interior sidewalls that define a channel through which the refrigerant flows. The hydraulic diameter of such a channel is typically determined by multiplying the cross sectional area of the channel by four and dividing that result by the wetted perimeter of the channel. The relatively small hydraulic diameter of the channel and the embossed surfaces of the conjoined plates produce a relatively high convective heat transfer coefficient for the refrigerant flowing through the tube. Despite this advantage, laminated tubes have certain drawbacks. For example, the embossed patterns on the surfaces of the plates make it difficult for the fins to bond to the surfaces. Furthermore, the plates are expensive to fabricate and result in tubes that can be subjected to relatively low refrigerant side pressure.

Certain flat tubes with a plurality of non-circular flow passages fabricated by using extrusion techniques do exist, which are designed to address the drawbacks associated with the laminated tube evaporator as described in the U.S patents bearing the U.S. Pat. Nos. 5,318,114; 6,161,616 and 6,449,979. However, none of these patents deal with the optimal dimensions of the circular or noncircular refrigerant flow passages within the extruded flat tubes nor do they deal with the optimal number of tubes in each pass of a multi-pass evaporator. The present invention is directed at high performance flat tube evaporators with enhanced refrigerant side passages of optimal dimensions and optimal number of tubes in each pass of a multi-pass evaporator.

The dominant heat transfer mechanism within the prior art evaporators is forced convection boiling, which is driven by the flow of the refrigerant through the flow channels. Forced convection boiling typically includes four stages. The first stage, or bubbly flow regime, is that in which the vapor mass fraction of the refrigerant is very low. In the second stage, or slug flow regime, the vapor volume fraction increases and individual bubbles begin to agglomerate to form plugs, or slugs, of vapor that move through the tube. The third stage, or annular flow regime, occurs when the interior walls of the tube are covered with a thin film of liquid refrigerant through which heat is absorbed. The mist flow regime is the final stage. During this stage, there is a sharp reduction in the boiling heat transfer coefficient of the refrigerant within the tube. Throughout all four stages, a nucleate boiling regime exists in selected areas of the tube, which results in quasi pool boiling of the refrigerant in those areas. However, the prior art tubes are not designed to ensure that such boiling optimizes the amount of heat transferred through the tube.

BRIEF SUMMARY OF THE INVENTION AND ADVANTAGES

Accordingly, the subject invention overcomes the limitations of the related art by providing a heat exchanger of the type in which a cross-flow of a fluid is directed in an upstream to downstream direction on the external surface of the heat exchanger to induce a transfer of thermal energy between the external fluid and a refrigerant circulating within the heat exchanger. The heat exchanger includes a pair of spaced tanks. A plurality of heat exchange tubes extends between the tanks in fluid communication therewith. At least one of the tubes includes a plurality of flow passages whose interior sidewalls define at least one corner having an included angle of less than ninety degrees to promote intense quasi pool boiling. Reducing the included angle of the corner increases the volume of the liquid refrigerant drawn into the corner by surface tension. This not only enhances nucleate boiling, but also creates secondary flow patterns normal to the primary flow of the refrigerant along the longitudinal axis of the passage defined by the interior sidewalls. An increase in the secondary flow causes a corresponding increase in turbulence within the passage, which further enhances quasi pool boiling and increases the rate of heat transfer through the tube.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of a heat exchanger according to an embodiment of the invention;

FIG. 2 is an exploded perspective view of the heat exchanger shown in FIG. 1;

FIG. 3 is an enlarged view of the heat exchanger shown in FIG. 2 illustrating the ends of a pair of the tubes;

DETAILED DESCRIPTION OF THE INVENTION

Referring to the Figures, wherein like numerals indicate like or corresponding parts throughout the several views, a heat exchanger is generally shown at 40 in FIGS. 1 and 2. The heat exchanger 40 is an evaporator of the type wherein an upstream to downstream fluid flow, such as airflow indicated by the arrow "D", is directed over its external surface, which induces a transfer of thermal energy between the external fluid flow and a refrigerant circulating through interior of the heat exchanger 40.

Figure 4:
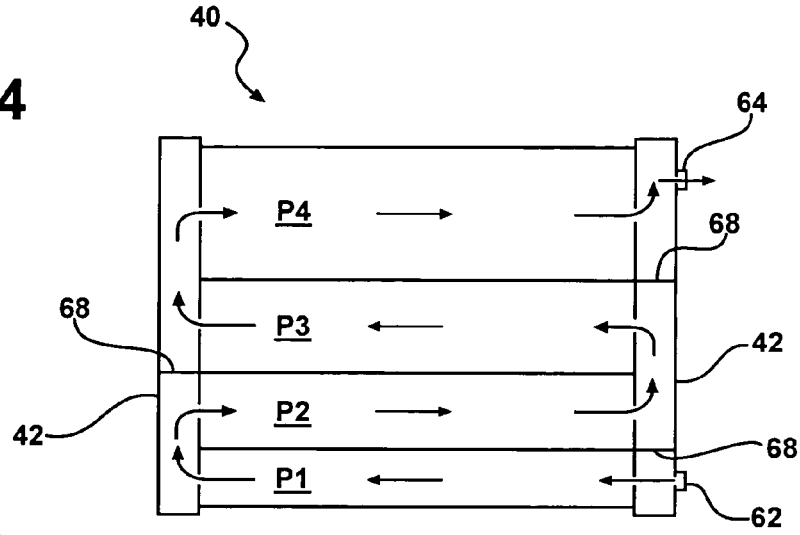
FIG. 4 is a schematic view of the heat exchanger shown in FIG. 1 illustrating an even number of flow passes.
Figure 5:
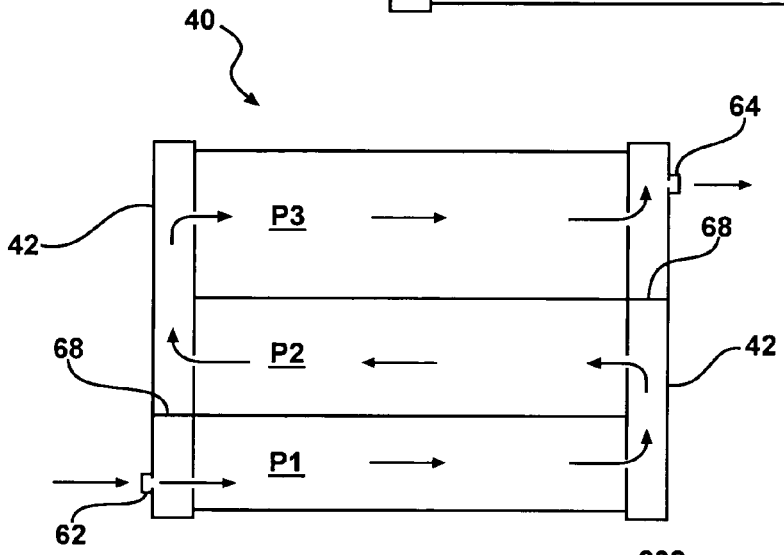
FIG. 5 is a schematic view of the heat exchanger shown in FIG. 1 illustrating an odd number of flow passes.

The heat exchanger 40 has an unfolded core design and includes a pair of spaced tanks 42 comprising a plurality of flow separators 68, shown clearly in FIGS. 4 and 5, to divide the incoming refrigerant flow into a number of flow passes (vide infra). A plurality of heat exchange tubes 44, divided into groups of tubes to correspond to various flow passes, extends between the tanks 42 in fluid communication therewith. As described in greater detail with reference to FIGS. 8 and 9 below, at least one of the tubes 44 includes interior sidewalls 46 having a flow passage 48 comprising at least one corner 50 with an included angle "θ" of less than or equal to ninety degrees. Preferably the angle "θ" is less than or equal to thirty degrees to promote intense quasi pool boiling within the flow passage 48. As is best shown in FIG. 2, each tank 42 includes a slotted header 52 with slots 54. The groups of tubes 44 have opposed ends 56 that are extended through the slots 54 in the respective headers 52 to permit refrigerant flow between the tanks 42. A plurality of convoluted, louvered fins 58 are positioned in alternating relation between the tubes 44 for permitting an external fluid to flow across the tubes 44 in the direction "D" shown.

The heat exchanger 40 also includes spaced upper and lower reinforcing plates 60 between which the tubes 44 and fins 58 are positioned. The reinforcing plates 60 extend parallel to the tubes 44 and interconnect the tanks 42 to form the heat exchanger core. A selected one of the tanks 42 includes an inlet tube 62 and an outlet tube 64. In FIG. 2, the inlet tube 62 and the outlet tube 64 are located in the same tank 42. However, they need not be located in the same tank 42. When the number of passes of the refrigerant flowing through the tubes 44 is even, the inlet tube 62 and the outlet tube 64 are located in the same tank 42 as in FIG. 2. When the number of passes is odd, the inlet tube 62 and the outlet tube 64 are located in the opposing tanks 42.

Referring to FIGS. 4 and 5, it is apparent that the multiple number of flow passes is caused by a plurality of flow separators 68 within the tanks 42 that divide the total number of tubes 44 into a number of tube groups P1, P2, P3, P4 etcetera, called flow passes, in fluid communication with each other through the tanks 42. Division of the total number of tubes 44 into flow passes P1, P2, P3, P4 etcetera forces the refrigerant to flow in a serpentine pattern across the external fluid flow a number of times depending on the number of flow passes. The refrigerant enters the tank 42 through the inlet tube 62, passes through the first pass P1 tubes into the opposing tank 42 and upon exit therefrom enters the second pass P2 tubes to flow back to the first tank 42. This pattern is repeated until the refrigerant exits through the outlet tube 64. In FIG. 4, the total number of tubes 44 is divided into four passes P1, P2, P3 and P4 by means of three flow separators 68. Accordingly, the heat exchanger 40 of FIG. 4 can be characterized as a four-pass heat exchanger. Note that in FIG. 4 the inlet tube 62 and the outlet tube 64 are located in the same tank 42 since the number of passes is even.

In FIG. 5, the total number of tubes 44 is divided into three passes P1, P2 and P3 by means of two flow separators 68. Accordingly, the heat exchanger 40 of FIG. 5 can be characterized as a three-pass heat exchanger. In this case, the inlet tube 62 and the outlet tube 64 are located in the opposing tanks 42 since the number of passes is odd.

The number of flow separators 68 is always one less than the number of desired flow passes. When there are no flow separators 68 in the tanks 42, the refrigerant enters the heat exchanger 40 through the inlet tube 62 located in one tank 42 and exits through the outlet tube 62 located in the opposing tank 42. Such a heat exchanger can be characterized as a single-pass heat exchanger since in such a heat exchanger the refrigerant makes a single pass across the external fluid.

Figure 6:
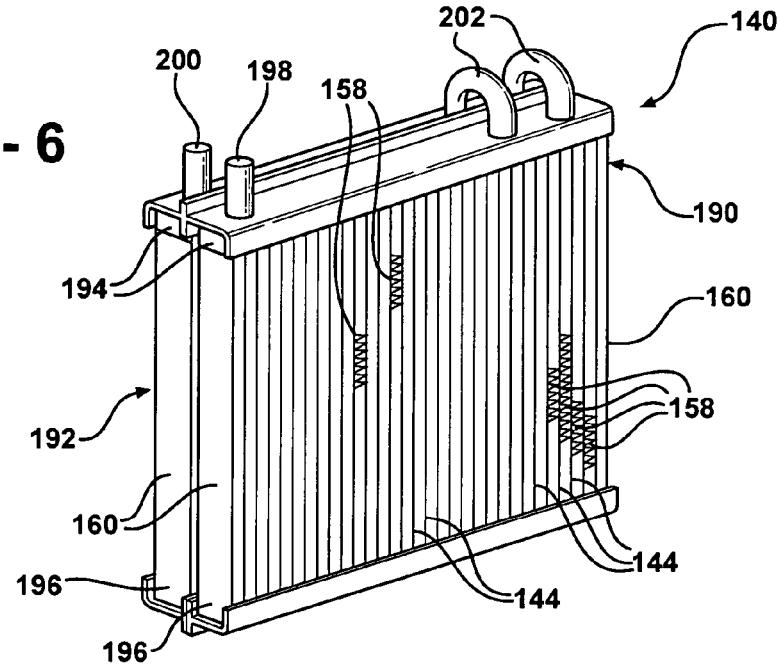
FIG. 6 is a perspective view of a heat exchanger according to an alternative embodiment of the invention.

Referring now to FIG. 6, a heat exchanger according to an alternative embodiment of the invention is generally shown at 140. Although the heat exchanger 140 includes many of the same components as the heat exchanger 40, the heat exchanger 140 differs in that it is an evaporator having a folded core design. Such a design is also referred to as a multi tank design. Specifically, the heat exchanger 140 includes front and rear evaporators 190, 192. Each evaporator 190, 192 includes an upper tank 194 and a lower tank 196. Also each evaporator 190, 192 comprises a pair of spaced side plates 160 interconnecting each pair of upper and lower tanks 194, 196. Heat exchange tubes 144 and fins 158, identical to the tubes 44 and fins 58 of the heat exchanger 40, are interposed in alternating relationship to one another between the reinforcing members 160. The tubes 144 extend in fluid communication between the respective pairs of upper and lower tanks 194, 196.

Figure 7:
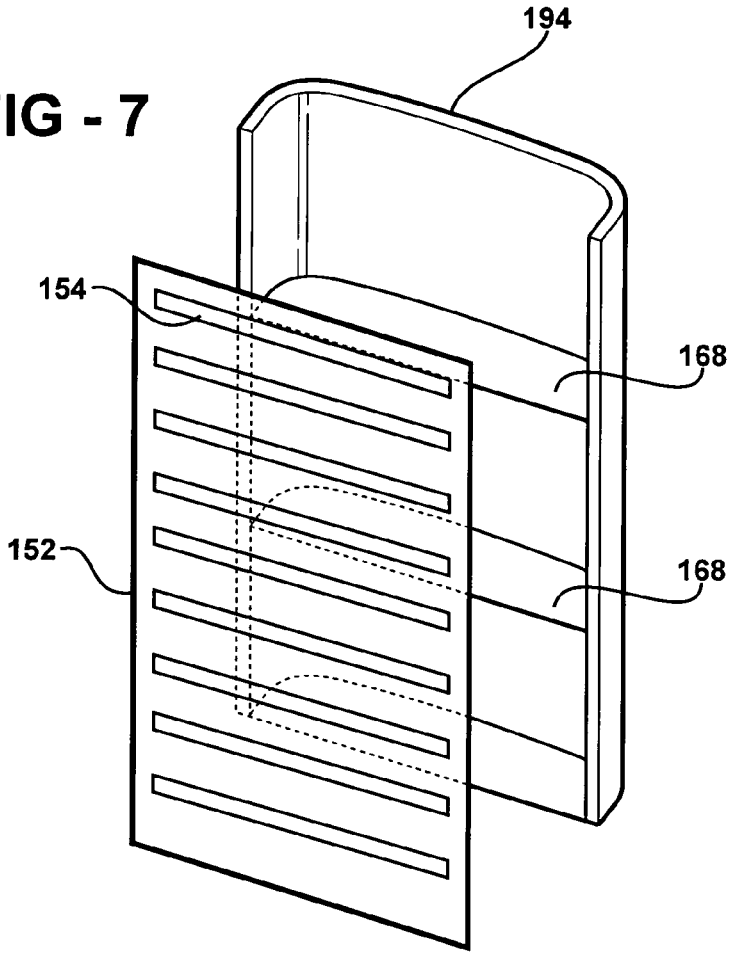
FIG. 7 is an exploded perspective view of a tank of the heat exchanger shown in FIG. 6.

FIG. 7 is an exploded view of the upper tank 194 of the front evaporator 190 showing a slotted header 152 with an array of slots 154 to admit tubes 144. Shown also in FIG. 7 is a plurality of flow separators 168 located within the tank 194 to divide the refrigerant flow into multiple passes P1, P2, P3, P4, etcetera. Similar slotted headers 152 and flow separators 168 are present in the upper tank 194 of the rear evaporator 192 as well in the pair of lower tanks 196.

As is shown in FIG. 6, the upper tank 194 of the front evaporator 190 includes an inlet tube 198 in fluid communication therewith, and the upper tank 194 of the rear evaporator 192 includes an outlet tube 200 in fluid communication therewith. One or more of U-shaped carry over tubes 202 interconnect the upper tank 194 of the front evaporator 190 to the upper tank 194 of the rear evaporator 192. The carry over tubes 202 may take different forms, such as an internally placed plate with holes, to facilitate transfer of refrigerant between the two heat exchangers. The refrigerant enters the heat exchanger 140 through the inlet tube 198, travels in a serpentine pattern through the tubes 144 in the front evaporator 190 and exits it through the carry over U-shaped tubes 202 before traveling into the upper tank 194 in the rear evaporator 192. The refrigerant then travels in a serpentine pattern through the tubes 144 in the rear evaporator 192 and exits the heat exchanger 140 through the outlet tube 200.

In FIG. 6, the inlet tube 198 and the outlet- tube 200 are both located in the upper pair of tanks 194. However, depending on the flow pass arrangement and the number of flow passes in the front evaporator 190 and the rear evaporator 192 the inlet tube 198 and the outlet tube 200 may both be located in the lower pair of tanks 196 or one in the upper tank 194 and other in the lower tank 196.

Figure 8:
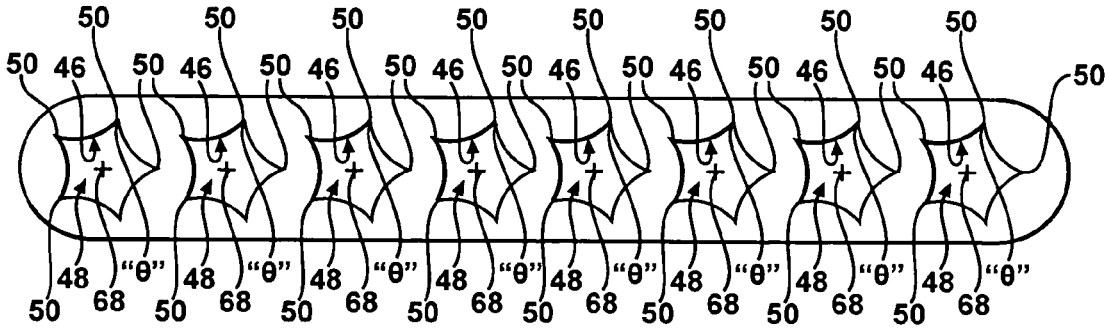
FIG. 8 is an end view of a tube of the heat exchanger shown in FIG. 1.

Referring now to FIG. 8, and using one of the tubes 44 as a representative example, the interior sidewalls 46 define a plurality of flow passages 48. As is shown in FIG. 8, each flow passage 48 has a longitudinal axis 68. Although the tubes 44 of the subject invention may have any number of flow passages 48 having any suitable shapes, the tube 44 in FIG. 8 has eight identical flow passages 48.

Figure 9:
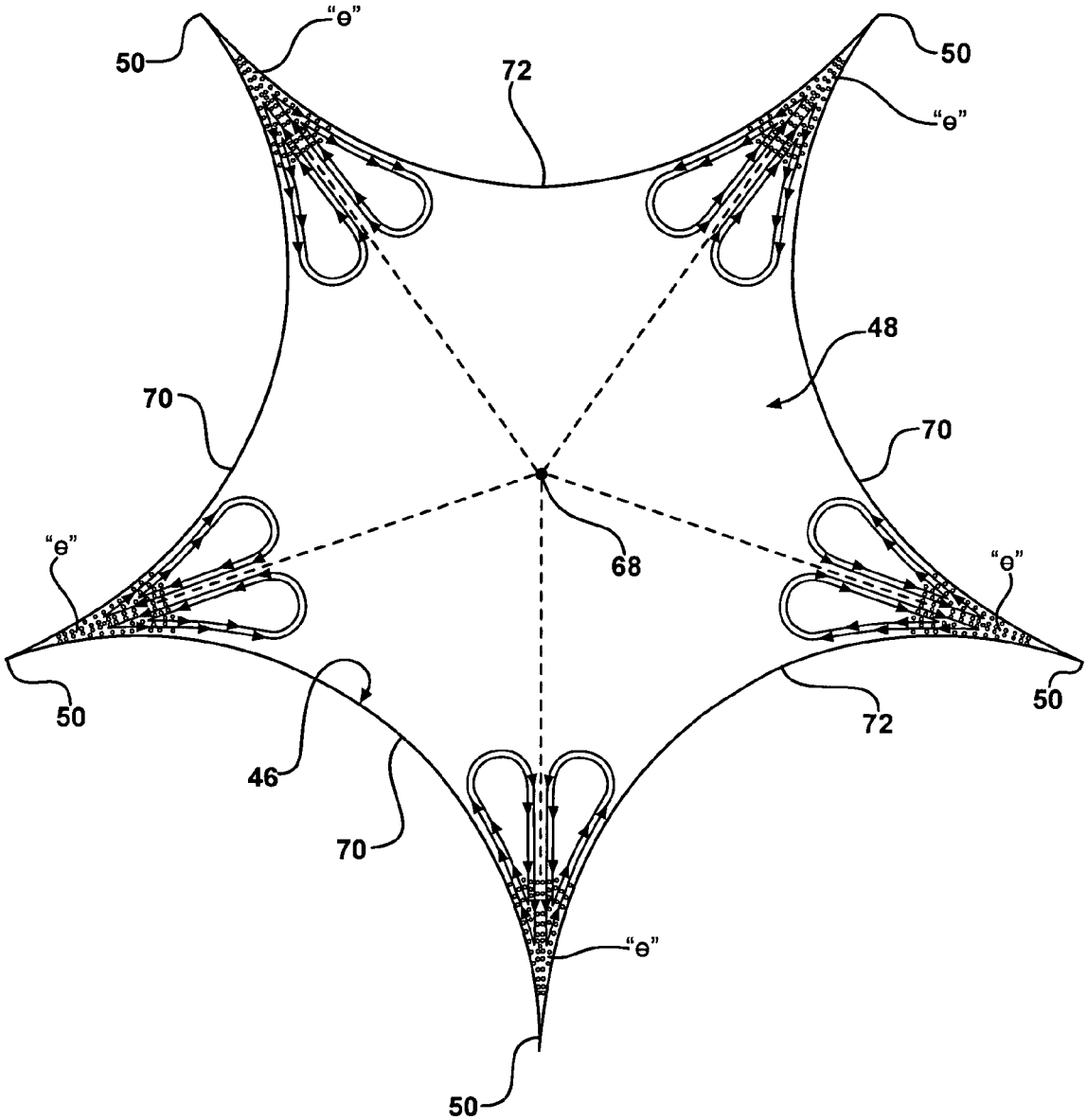
FIG. 9 is an enlarged view of the tube shown in FIG. 8 illustrating a selected flow passage of the tube with secondary flow pattern in the corner regions.

Referring now to FIG. 9, the flow passage 48 is bounded by a first side 70 that extends from a first one of the corners 50 in an arcuate shape. The flow passage 48 further includes a second side 72 that extends from the first corner 50. Although not required, the second side 72 also extends in an arcuate shape from the first corner 50. While they may have any arcuate shapes, the first and second sides 70, 72 are concave curves. The flow passage 48 further includes a second corner 50. The first side 70 extends to the second corner 50. The flow passage 48 also includes a third corner 50 to which the second side 72 extends.

Although the flow passage 48 may have any shape, the flow passage 48 shown in FIG. 8 defines a hypocycloid having a plurality of corners 50 with a plurality of concave sides 70, 72 interconnecting the corners 50. Furthermore, although the corners may have any suitable angles less than or equal to ninety degrees, each corner 50 in FIG. 8 has an included angle "θ" of less than or equal to thirty degrees, which is particularly suitable for promoting intense pool boiling in the corner regions as explained below.

Figure 10:
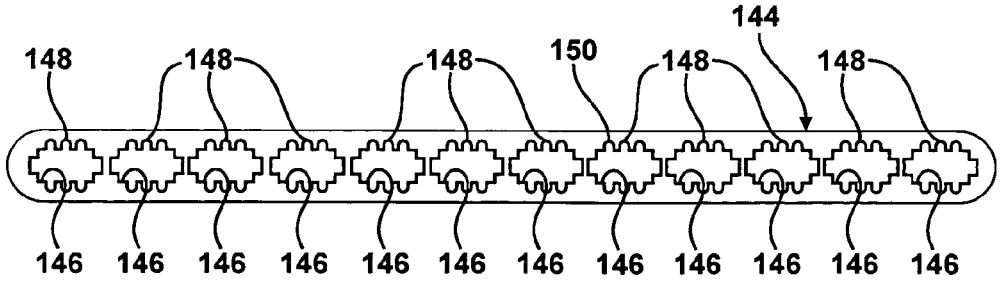
FIG. 10 is an end view of a tube with another selected flow passage with slightly rounded corners.

FIG. 10 shows a more complex flow passage 148 incorporated in a tube 144 with a plurality of slightly rounded corners 150 formed by a plurality of straight or arcuate sides 146. The slightly rounded corners 150 are slightly less effective in promoting quasi pool boiling than the sharp corners 50. However, they are more desirable from the standpoint of manufacturing the tube so as to allay concerns about stress concentration in the corner regions of the tube.

Referring back to FIG. 9 and using the noncircular flow passage 48 as a representative example, it is recognized that each of the corners 50 within the flow passage 48 promotes quasi pool boiling of the refrigerant with corner regions serving as the nucleation sites to trigger such boiling. The refrigerant is drawn into the corners 50 to form a quasi-stagnant refrigerant pool by the surface tension of the liquid refrigerant flowing through the passage 48. The smaller the corner radius the stronger is the surface tension force drawing refrigerant into the corner 50. Hence sharper corners 50 having smaller included angles "θ" are more effective in drawing the liquid refrigerant into the corners 50. As explained below, with the included angle "θ" less than thirty degrees, the pool boiling becomes more intense due to the coexistence of laminar flow in the corner regions with the turbulent flow through the remainder of the flow passage cross-section.

The turbulent flow through a circular passage is predominantly unidirectional with only turbulent flow characteristics. On the other hand, the turbulent flow through a noncircular passage, like 48 with sharp corners 50, is bidirectional possessing both turbulent and laminar flow characteristics. The turbulently flowing refrigerant is drawn into the corner regions by the surface tension effect, which gives rise to a non-zero transverse velocity component normal to the interior sidewalls 46. This velocity component, significantly smaller than the turbulent axial velocity component, is laminar in characteristic due to quasi-stagnant nature of the liquid pool formed in the corner region and depends solely on the shape of flow passage 48. Thus springs into existence a coexisting laminar flow within a noncircular passage 48 with sharp corners and turbulently flowing fluid through the flow passage 48. It is found that the coexistence of the laminar flow is particularly predominant when the radius of the corner 50 is small with the included angle "θ" less than or equal to thirty degrees.

Figure 11:
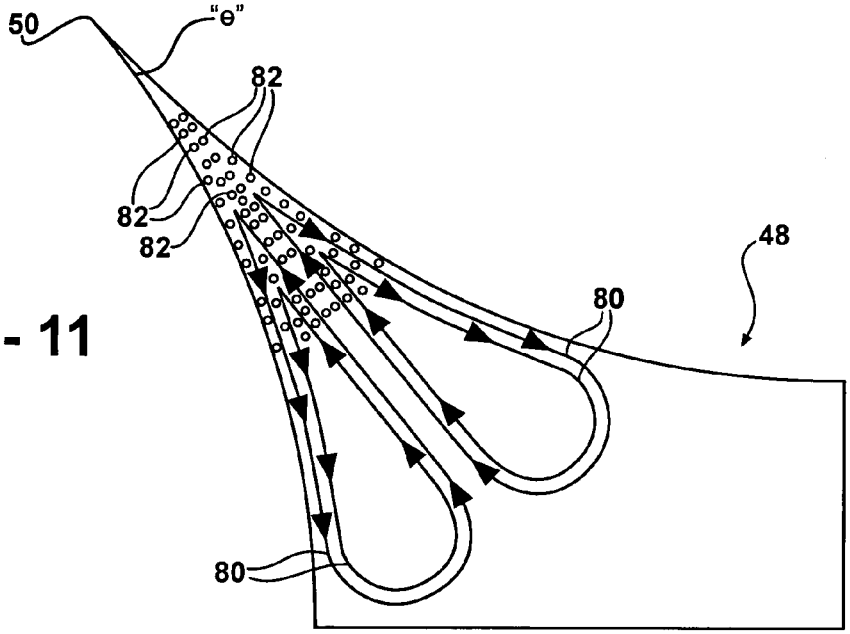
FIG. 11 is an enlarged view of the flow passage shown in FIG. 8 illustrating a selected corner with a secondary flow pattern.
Figure 12:
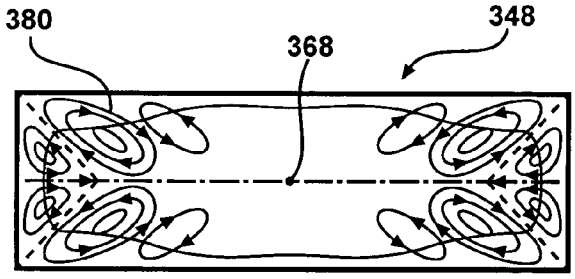
FIG. 12 is a schematic view of a rectangular flow passage illustrating a secondary flow pattern.
Figure 13:
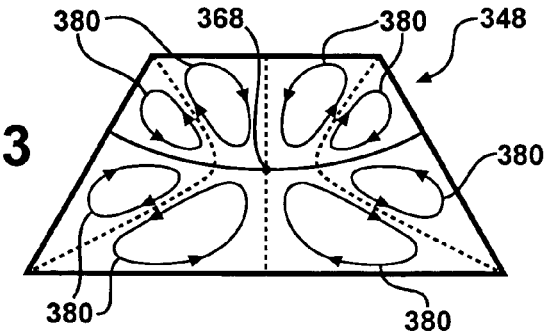
FIG. 13 is a schematic view of a trapezoidal flow passage illustrating a secondary flow pattern.
Figure 14:
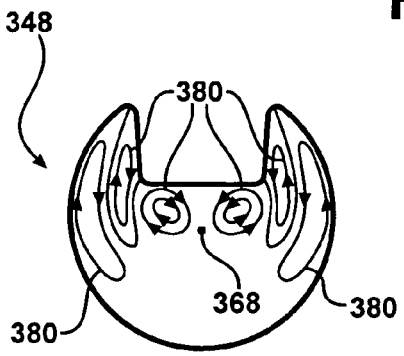
FIG. 14 is a schematic view of a circular flow passage having a single rectangular indentation illustrating a secondary flow pattern.
Figure 15:
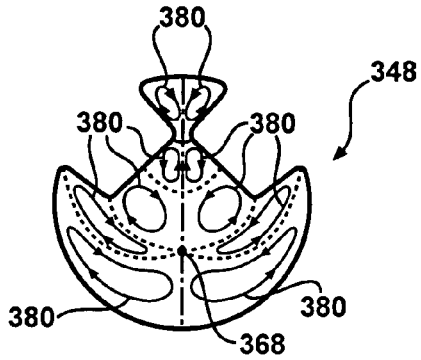
FIG. 15 is a schematic view of a circular passage having a pair of rectangular indentations illustrating a secondary flow pattern.
Figure 16:
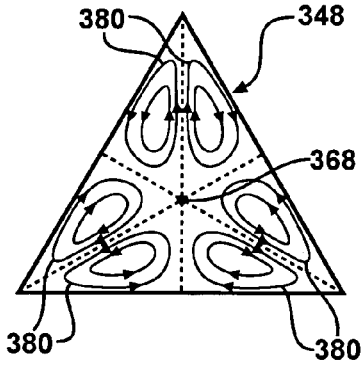
FIG. 16 is a schematic view of an equilateral triangular flow passage illustrating a secondary flow pattern.
Figure 17:
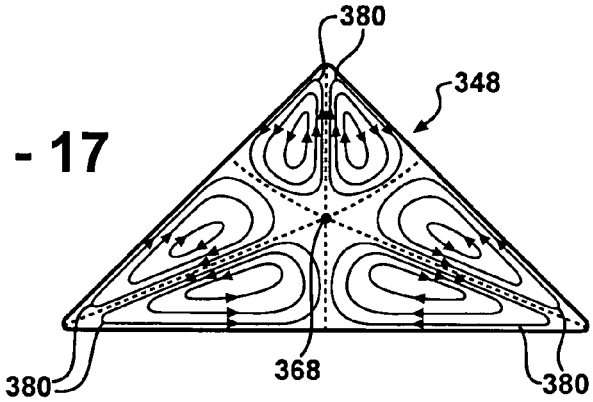
FIG. 17 is a schematic view of a right-angled isosceles triangular flow passage illustrating a secondary flow pattern.

Referring now to FIG. 11, a representative example of one of the corners 50 in a non-circular passage 48 is shown. The axial component of the turbulent flow through the noncircular flow passage 48 is perpendicular to the plane of the figure while the normal component of the velocity is in the plane of the figure indicated by the flow lines 80 centered in the corner regions. The axial flow component is referred to as the "primary" flow and the non-zero, normal flow component 80 is referred to as the "secondary" flow. While the primary flow is turbulent in nature the secondary flow is laminar in nature due to quasi-stagnant characteristic of the refrigerant in the corner regions, as explained above.

Figure 18:
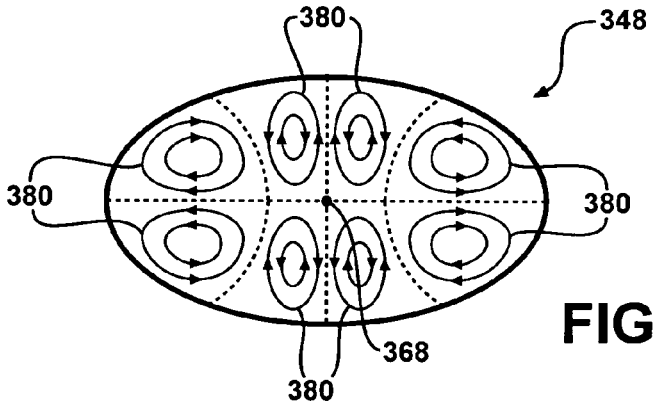
FIG. 18 is a schematic view of an elliptical flow passage illustrating a secondary flow pattern.

The secondary flow does not exist in a circular flow passage with uniformly varying passage wall curvature. Presence of a surface discontinuity in the passage wall is a necessary condition for the existence of a secondary flow in a noncircular flow passage. The surface discontinuity need not be sharp like a knife-edge. It can be a relatively mild discontinuity with non-uniformly varying wall curvature as in an elliptical flow passage. It is only in the limit when an elliptical passage degenerates into a circular passage with uniformly varying wall curvature that the secondary flow disappears. FIGS. 12 through 17 show the secondary flow patterns in noncircular passages, including rectangular, trapezoidal and triangular, with sharply varying wall curvature while FIG. 18 shows the secondary flow patterns in an elliptical flow passage with continuously varying non-uniform wall curvature.

The mean velocity of the primary flow as well as that of the secondary flow 80 depends solely on the coordinates of the cross section of the flow passage 48. The mean velocity of the secondary flow 80 is approximately 1% to 2% of the mean velocity of the primary flow. Notwithstanding the low magnitude of the secondary flow mean velocity, it exerts a measurable effect in increasing the friction factor coefficient and the heat transfer coefficient for the flow passage. Both of these coefficients are approximately 10% greater in the corners 50 dominated by the secondary flow 80 than in the areas of the tube 44 dominated by the primary flow.

Referring now to FIGS. 12 through 18, the secondary flow patterns 380 within various noncircular flow passages 348 are shown. The primary flow through the flow passages 348 shown in FIGS. 12 through 18 is unidirectional and normal to the plane of the paper (i.e., parallel to the longitudinal axes 368 of the tubes 344 defining the respective flow passages 348). The secondary flow 380 occurs in the plane of the paper normal to the primary flow moving the quasi-stagnant fluid along the bisectors of the angles into the primary flow stream and replenishing the quasi-stagnant fluid in the corners with fresh fluid from the primary flow stream. This mixing action of the secondary flow enhances forced convection boiling within the flow passages 348.

The heat transfer rate through the tubes 44, 144 with flow passages set forth in FIGS. 12 through 18 and 20 through 34 is further increased by allocating a specific number of tubes to each flow pass within the heat exchanger. When flowing through the tubes in an evaporator, the refrigerant changes from a two-phase liquid and vapor mixture to a single-phase saturated or alternatively, slightly superheated, vapor. Because a higher percentage of the refrigerant in the first pass is in the liquid phase as compared to the gas phase, the density of the refrigerant in the first pass is greater than the density of the refrigerant in the last pass. Thus, the number of tubes to be included in each flow pass must progressively increase from the first to the last pass in an evaporator.

When flowing through the tubes in a condenser, the refrigerant changes from a single-phase vapor to a two-phase mixture of saturated liquid. In this case since a higher percentage of the refrigerant in the first pass is in the vapor phase as compared to the liquid phase, the density of the refrigerant in the first pass is smaller than the density of the refrigerant in the last pass. Thus, the number of tubes to be included in each flow pass must progressively decrease from the first to the last pass in a condenser.

Table 1 sets forth the fractions of the optimal number of tubes to be apportioned in each pass of an evaporator. Row 1 of Table 1 indicates the number of flow passes ranging from 1 to 10. Column 1 gives the fraction of the tubes to be apportioned to the single pass of the one-pass evaporator. Clearly the number of tubes that can be assigned to the single pass of a one-pass evaporator equals the total number of tubes in the evaporator. Hence the ratio of the number of tubes in the one pass to the total number of tubes in the evaporator is 1. Column 2 indicates the optimal number of tubes that can be assigned to a two-pass evaporator. The tabular results show that the optimal ratio of the number of tubes in pass P1 to the total number of tubes in the two-pass evaporator is 0.3981 while the optimal ratio of the number of tubes in pass P2 to the total number of tubes in the two-pass evaporator is 0.6019. Similarly, columns 3 through 10 indicate the optimal ratios of the number of tubes in each pass of a three-pass through a ten-pass evaporator.

Figure 35:
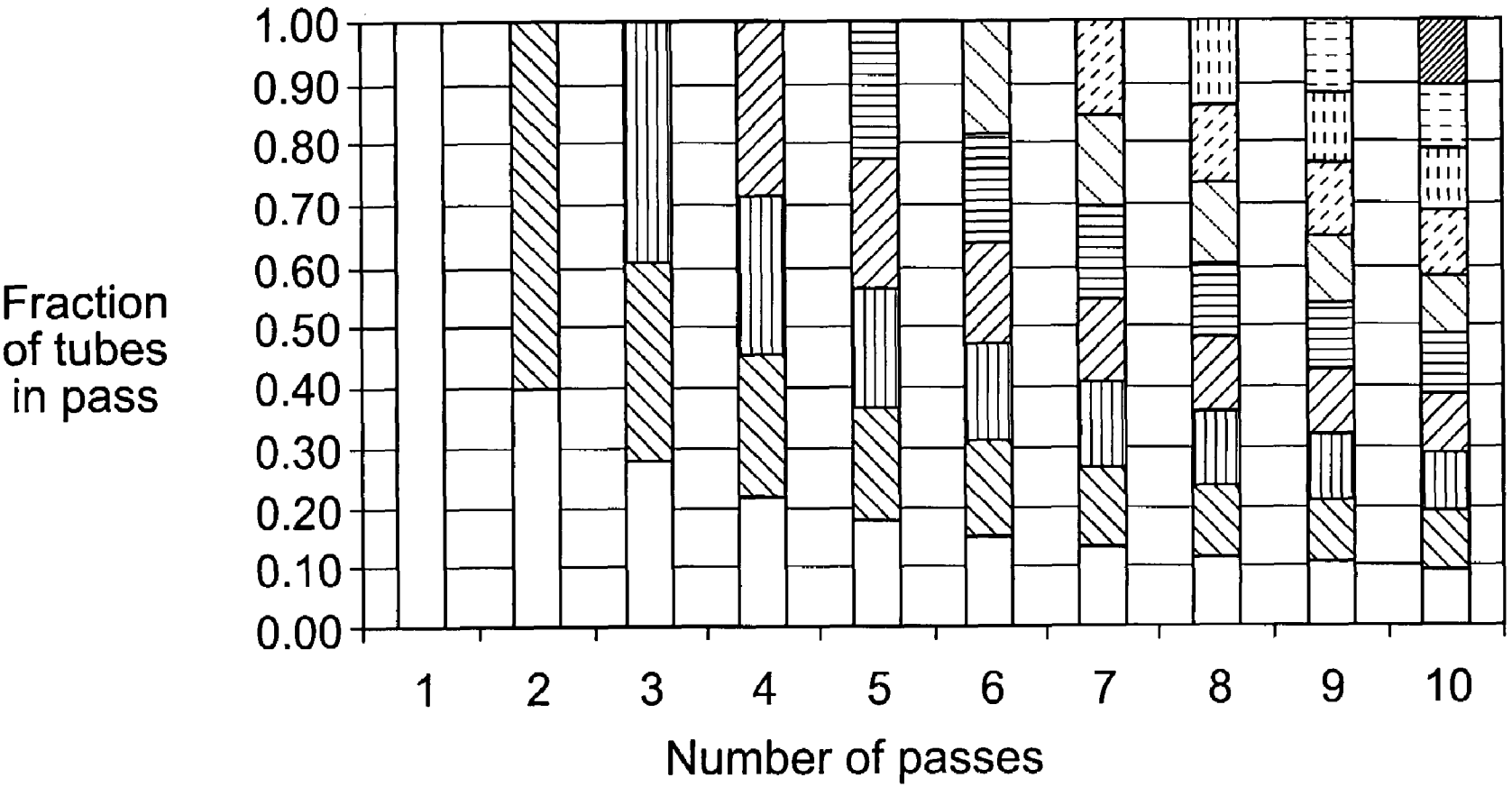
FIG. 35 is a bar chart representing optimal fraction of the tubes to be assigned to each pass of a multi pass evaporator.

The results of Table 1 are also represented in the form of a bar chart in FIG. 35, which shows an array of stacked bars wherein the lowest sub bar in each stacked bar represents fraction of the tubes in the first pass and the highest sub bar in each stacked bar represents fraction of the tubes in the last pass.

TABLE 1

Optimal Fraction of Tubes to be assigned to Each Pass of an Evaporator

| 1 | 2 | 3 | 4 | 5 | 6 | 7 | 8 | 9 | 10 |
|---|---|---|---|---|---|---|---|---|---|
| 1 | 0.3981 | 0.2764 | 0.2153 | 0.1769 | 0.1503 | 0.1306 | 0.1155 | 0.1036 | 0.0939 |
| | 0.6019 | 0.3333 | 0.2384 | 0.1885 | 0.1568 | 0.1347 | 0.1182 | 0.1055 | 0.0952 |
| | | 0.3903 | 0.2616 | 0.2000 | 0.1634 | 0.1388 | 0.1209 | 0.1073 | 0.0966 |
| | | | 0.2847 | 0.2115 | 0.1699 | 0.1429 | 0.1236 | 0.1092 | 0.0980 |
| | | | | 0.2231 | 0.1765 | 0.1469 | 0.1264 | 0.1111 | 0.0993 |
| | | | | | 0.1831 | 0.1510 | 0.1291 | 0.1130 | 0.1007 |
| | | | | | | 0.1551 | 0.1318 | 0.1149 | 0.1020 |
| | | | | | | | 0.1345 | 0.1168 | 0.1034 |
| | | | | | | | | 0.1186 | 0.1048 |
| | | | | | | | | | 0.1061 |

To illustrate the manner in which Table 1 is used, assume that a single evaporator core, as shown in FIG. 1, must include a total of sixty identical tubes with four passes in the core. As is shown in Table 1, the ratio of the number of tubes in the first, second, third and fourth passes to the total number of tubes in the core is 0.2153, 0.2384, 0.2616 and 0.2847, respectively. The total number of tubes in each of the passes is determined by multiplying the total number of tubes to be used in the core by the ratio assigned to each given pass as follows:

Number of tubes in first pass=60×0.2153=12.9≅13

Number of tubes in second pass=60×0.2384=14.3≅14

Number of tubes in third pass=60×0.2616=15.7≅16

Number of tubes in fourth pass=60×0.2847=17.1≅17.

Referring now to FIGS. 20 through 34, the subject invention also includes a method for determining the optimal hydraulic diameter "d" of a selected noncircular flow passage within a tube of the subject invention. The passage-specific optimal hydraulic diameter "d" can be determined by the relationship between said optimal hydraulic diameter "d" of the passage and the optimal hydraulic diameter "$d_o$" of a baseline circular passage given by the relationship $$d_o = \frac{\dot{m}\Phi}{\mu} \tag{1}$$

wherein,

- $d_o$ is the hydraulic diameter of the baseline circular flow passage expressed in ft or m,
- $\mu$ is the dynamic viscosity of a saturated liquid-vapor mixture expressed in $lb_m$/ft·hr or Pa·s,
- $\dot{m}$ is the mass flow rate of the refrigerant through the flow passage expressed in $lb_m$/hr or kg/s
- $\Phi$ is a dimensionless flow parameter dependent on the dimensionless property parameter, called Prandtl number Pr, defined as $$Pr = \frac{\mu c_p}{k} \tag{2}$$

wherein

- $\mu$ is the dynamic viscosity of a saturated liquid-vapor mixture expressed in $lb_m$/ft·hr or Pa·s,
- $c_p$ is the isobaric specific heat of the saturated liquid-vapor mixture expressed in Btu/$lb_m$·° F. or kJ/kg·K,
- k is the thermal conductivity of the saturated liquid-vapor mixture expressed in Btu/ft·hr·° F. or W/m·K.

Figure 19:
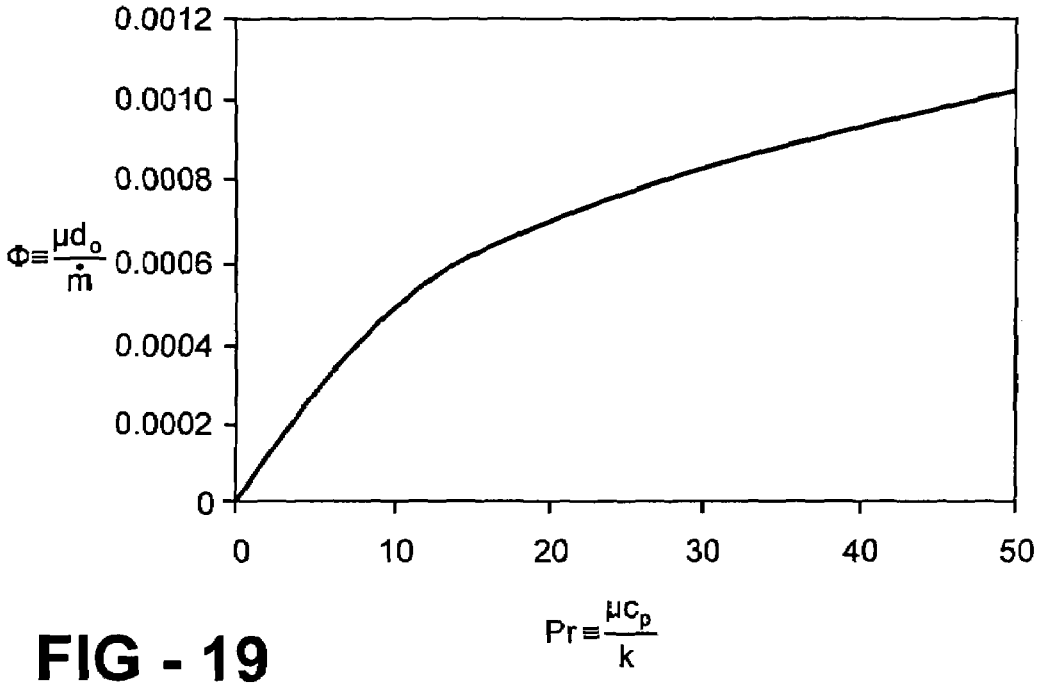
FIG. 19 is a graph illustrating the relationship between the dimensionless fluid flow parameter "Φ" involving the optimal hydraulic diameter "$d_o$" of a circular flow passage and the dimensionless fluid property parameter called Prandtl number "Pr"
Figure 20:
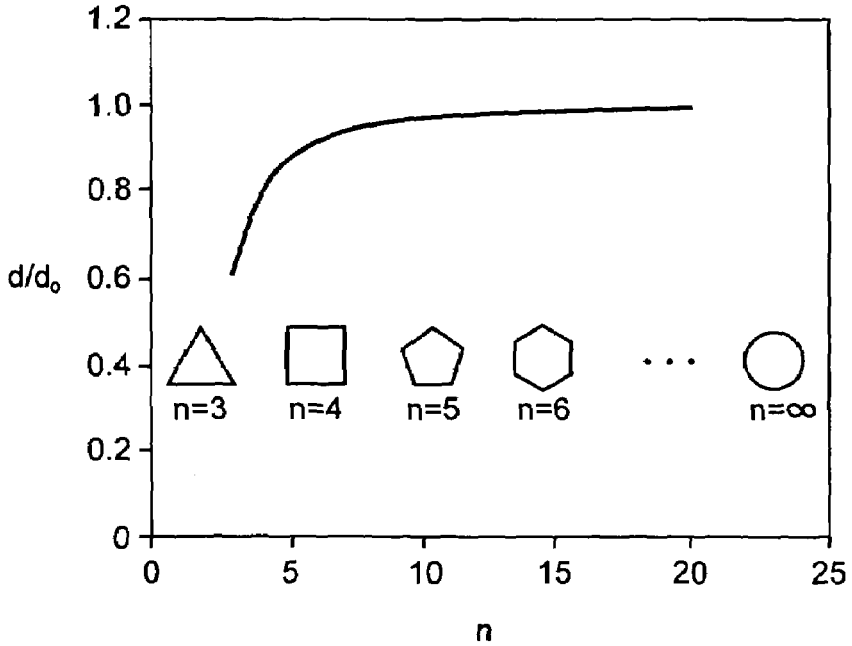
FIG. 20 is a graph illustrating the relationship between the number of sides, "n", of a polygonal flow passage and the ratio of the optimal hydraulic diameter "d" of a polygonal flow passage to the optimal hydraulic diameter "$d_o$" of a circular flow passage.

In order to calculate the optimal hydraulic diameter "d" of a noncircular passage, the optimal hydraulic diameter "$d_o$" of a baseline circular passage must first be determined using Equation (1) in conjunction with the graph set forth in FIG. 19, which gives variation of the dimensionless flow parameter $\Phi$, entering Equation (1), with the dimensionless property parameter Pr. The use of Equation (1) in conjunction with the graph set forth in FIG. 19 will now be illustrated by means of an example.

By way of an example, suppose that a refrigerant flows through an evaporator core in the form of a mixture of saturated liquid and vapor. In order to determine the properties of such a mixture, the properties of the saturated liquid and saturated vapor are required. The refrigerant quality "$\chi$", which is the vapor mass fraction as a weighting factor for the properties of the mixture, is also required. Although any suitable refrigerant may be utilized with the subject invention, by way of non-limiting example, R-134a is utilized in the examples set forth herein assuming that refrigerant R-134a is flowing through the evaporator core at a temperature of 50° F. and has an average refrigerant quality "$\chi$"=0.7. The transport properties for R-134a refrigerant at a temperature of 50° F. are set forth in Table 2. Throughout Table 2, the subscript "f" denotes the saturated liquid and the subscript "g" denotes the saturated vapor.

As is set forth in Table 2, the dimensionless Prandtl number "Pr" of the R-134a liquid-vapor mixture having an average refrigerant quality "$\chi$" equal to 0.70 is 1.7126. Corresponding to this value of the dimensionless Prandtl number "Pr", we obtain from the graph of FIG. 19 the value of the dimensionless flow parameter "$\Phi$" as 0.00018.

Table 2. Data for the Calculation of the Optimal Hydraulic Diameter "$d_o$" of a Baseline Circular Passage Utilizing R-134a Refrigerant at 50° F.

| | |
|---|---|
| $\chi$ | 0.70 |
| $\mu_g$ | 0.0315 $lb_m$/ft · hr (0.000013 Pa · s) |
| $\mu_f$ | 0.5978 $lb_m$/ft · hr (0.000247 Pa · s) |
| $\mu = \mu_g^{\chi}\mu_f^{1-\chi}$ | 0.0762 $lb_m$/ft ·hr (0.000031 Pa · s) |
| $c_{pg}$ | 0.1967 Btu/$lb_m$ · ° F. (0.8235 kJ/kg · K) |
| $c_{pf}$ | 0.3276 Btu/$lb_m$ · ° F. (1.3716 kJ/kg · K) |

-continued

| | |
|---|---|
| $k_g$ | 0.0069 Btu/ft · hr · ° F. (0.0119 W/m · K) |
| $k_f$ | 0.0542 Btu/ft · hr · ° F. (0.0937 W/m · K) |
| $Pr_g = \mu_g c_{pg}/k_g$ | 0.8980 |
| $Pr_f = \mu_f c_{pf}/k_f$ | 3.6133 |
| $Pr = \chi Pr_g + (1 - \chi) Pr_f$ | 1.7126 |

The dynamic viscosity "μ" of R-134a refrigerant corresponding to an average refrigerant quality "χ" equal to 0.70 at 50° F. is also required for the calculation of "$d_o$" with the use of Equation (1). Referring to Table 2, this value is determined to be 0.0762 $lb_m$/ft·hr.

Finally, the mass flow rate "ṁ" through the flow passage needs to be prescribed in order to compute "$d_o$" using Equation (1). Assuming that the total mass flow rate of R-134a through the evaporator is 420 $lb_m$/hr based on the system sizing considerations and that the average number of flow passages within the evaporator tubes defining each flow pass is 300, we can determine the mass flow rate ṁ through each flow passage as 420/300=1.4 $lb_m$/hr.

Thus given that "Φ"=0.00018, "ṁ"=1.4 $lb_m$/hr and "μ"=0.0762 $lb_m$/ft·hr, we find that all the information for the computation of "$d_o$" using Equation (1) is now at hand. Using these values in Equation (1) set forth above, the optimal hydraulic diameter "$d_o$" of the baseline circular flow passage is found to be equal to 0.0033 ft=0.040 in. (1 mm).

Once the optimal hydraulic diameter "$d_o$" of the baseline circular passage has been determined, the optimal hydraulic diameter "d" of any given noncircular passage can be determined. Specifically, the optimal hydraulic diameters "d" of the respective noncircular passages represented by the cross-sectional areas shown in FIGS. 20 through 34 can be calculated using the graphical results and data set forth in those Figures.

Figure 21:
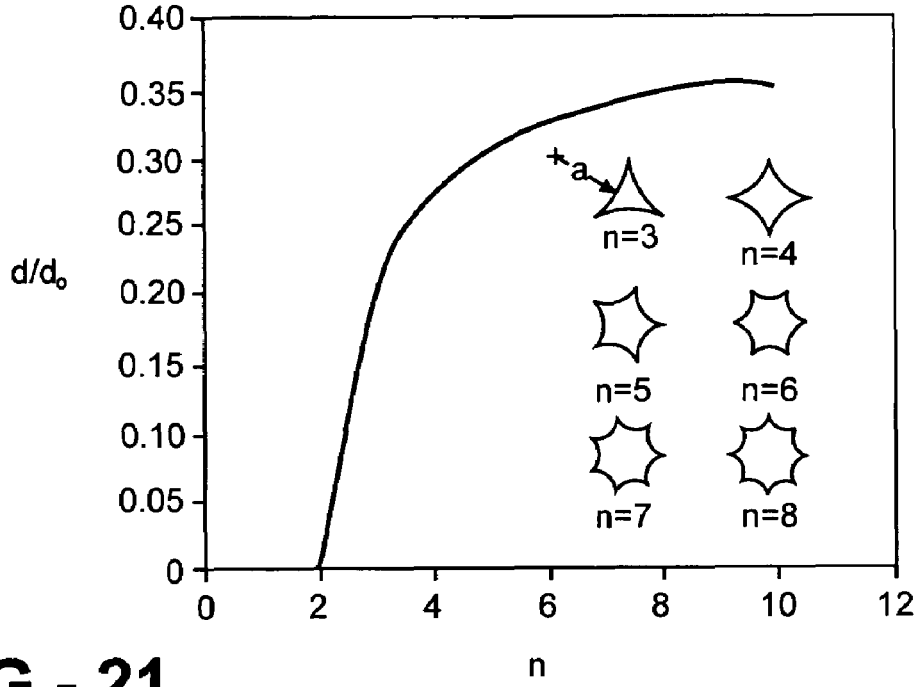
FIG. 21 is a graph illustrating the relationship between the number of sides, "n", of a cusped flow passage and ratio of the optimal hydraulic diameter "d" of a cusped flow passage to the optimal hydraulic diameter "$d_o$" of a circular flow passage.

The example described in the following paragraphs illustrates the manner in which the optimal hydraulic diameter "d" of a noncircular passage, such as a cusped passage shown in FIG. 21, is determined when the optimal hydraulic diameter "$d_o$" of a baseline circular passage is known.

Referring to FIG. 21, the diameter ratios "$d/d_o$" for members of a family of cusped passages are shown. The graph set forth in FIG. 21 also illustrates the extent to which the value of "$d/d_o$" varies with the number of sides "n" of a given cusped passage. The values of "$d/d_o$", plotted in FIG. 21 as a function of the number of sides "n" of the cusped passages, are also set forth in column 2 of Table 3.

TABLE 3

Calculation of the Optimal Hydraulic Diameter "d" of Cusped Passages utilizing R-134a Refrigerant

| N | $d/d_o$ | d, in. (mm) |
|---|---|---|
| 3 | 0.2053 | 0.0082(0.2053) |
| 4 | 0.2732 | 0.0109(0.2732) |
| 5 | 0.3069 | 0.0122(0.3069) |
| 6 | 0.3270 | 0.0131(0.3270) |
| 7 | 0.3403 | 0.0136(0.3403) |
| 8 | 0.3497 | 0.0140(0.3497) |
| 9 | 0.3568 | 0.0143(0.3568) |
| 10 | 0.3623 | 0.0145(0.3623) |

Assume that the operating conditions of an evaporator utilizing tubes incorporating the cusped flow passages are identical to those of the evaporator described above in Table 2 and in paragraphs following Table 2. Thus, under these conditions the optimal hydraulic diameter "$d_o$" of the baseline circular passage can be taken as 0.040 in (1 mm) as computed above with the use of Equation (1). Given this value of "$d_o$" and the values of the ratio "$d/d_o$" for the respective cusped passages in the graph of FIG. 21 as well as in column 2 of Table 3, the optimal hydraulic diameter "d" for each of the cusped passages can be calculated. The calculated values are set forth in column 3 of Table 3.

Figure 22:
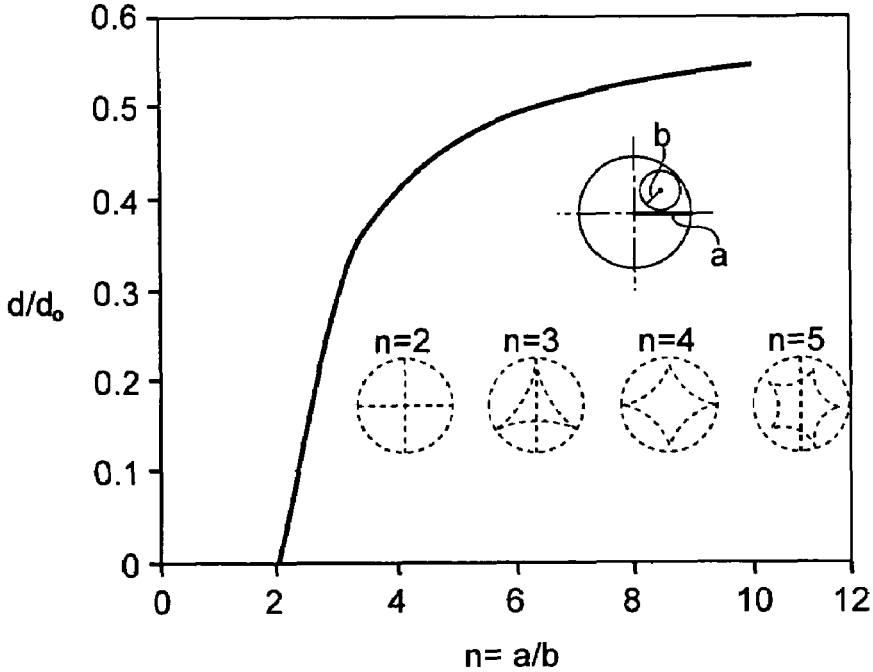
FIG. 22 is a graph illustrating the relationship between the number of sides, "n", of a hypocycloidal flow passage and ratio of the optimal hydraulic diameter "d" of a hypocycloidal flow passage to the optimal hydraulic diameter "$d_o$" of a circular flow passage.
Figure 23:
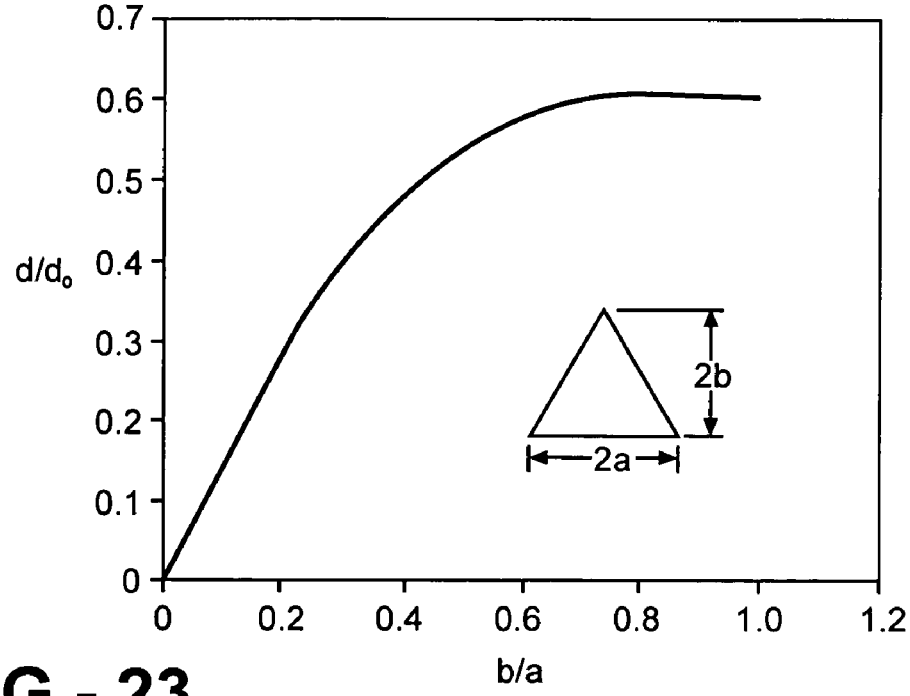
FIG. 23 is a graph illustrating the relationship between the ratio of the height "2b" to the base "2a" of an isosceles triangular flow passage and the ratio of the optimal hydraulic diameter "d" of an isosceles triangular flow passage to the optimal hydraulic diameter "$d_o$" of a circular flow passage.
Figure 24:
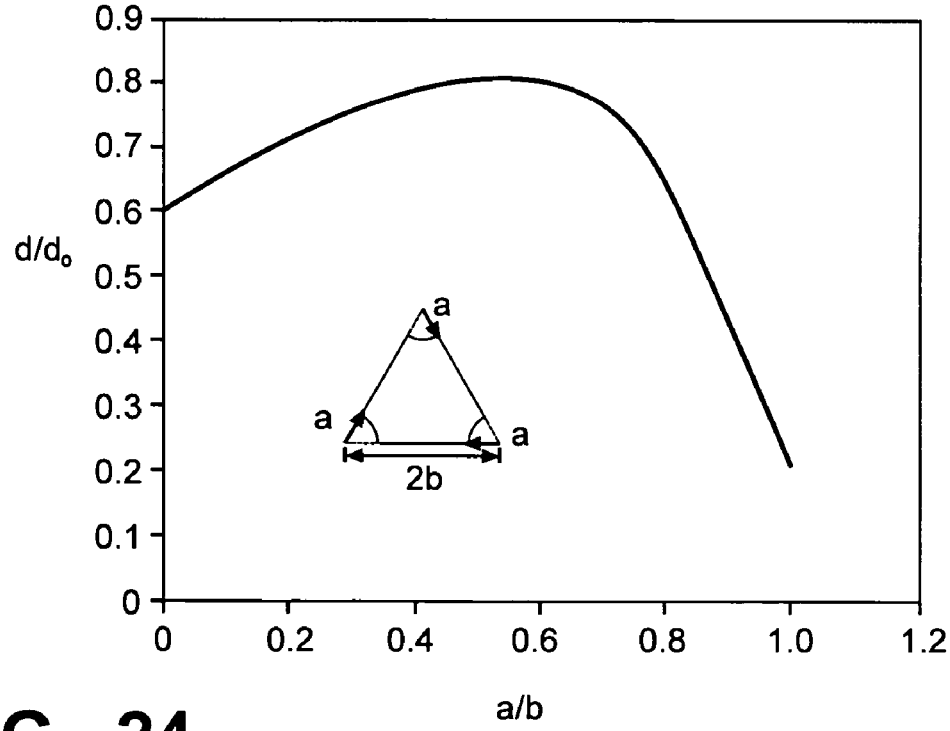
FIG. 24 is a graph illustrating the relationship between the ratio of the corner radius "a" to the base half-width "b" of an equilateral triangular flow passage with rounded corners and the ratio of the optimal hydraulic diameter "d" of an equilateral triangular flow passage with rounded corners to the optimal hydraulic diameter "$d_o$" of a circular flow passage.
Figure 25:
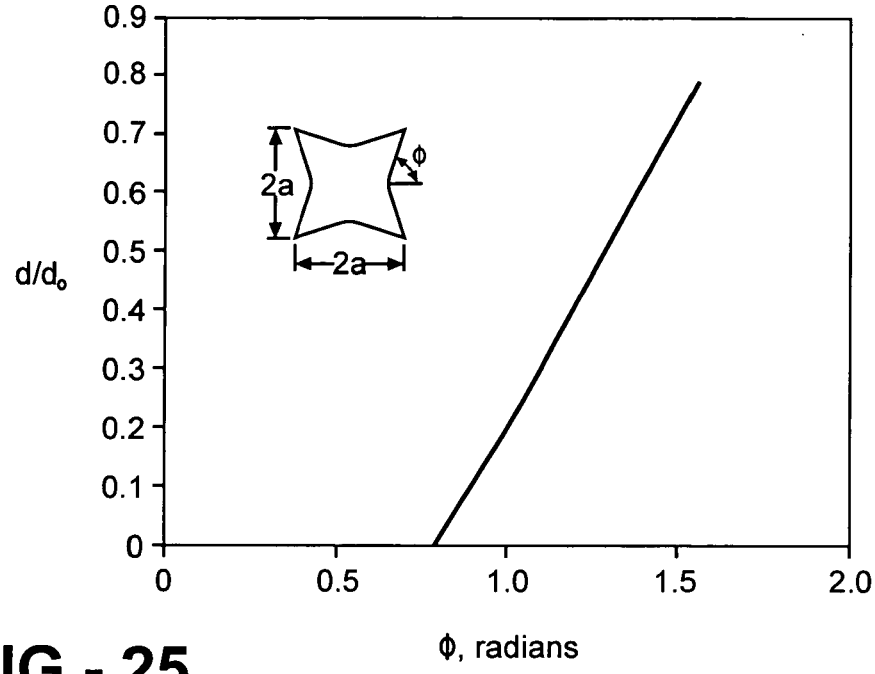
FIG. 25 is a graph illustrating the relationship between the angle of inclination "φ" of one side of a four-point star passage and the ratio of the optimal hydraulic diameter "d" of a four-point star flow passage to the optimal hydraulic diameter "$d_o$" of a circular flow passage.
Figure 26:
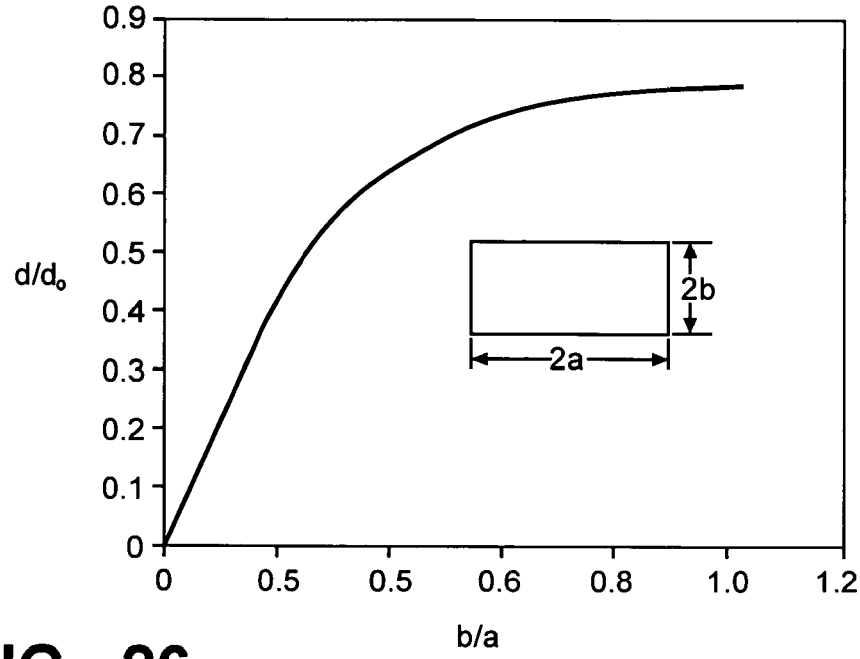
FIG. 26 is a graph illustrating the relationship between the ratio of the height "2b" to the base "2a" of a rectangular flow passage and the ratio of the optimal hydraulic diameter "d" of a rectangular flow passage to the optimal hydraulic diameter "$d_o$" of a circular flow passage.
Figure 27:
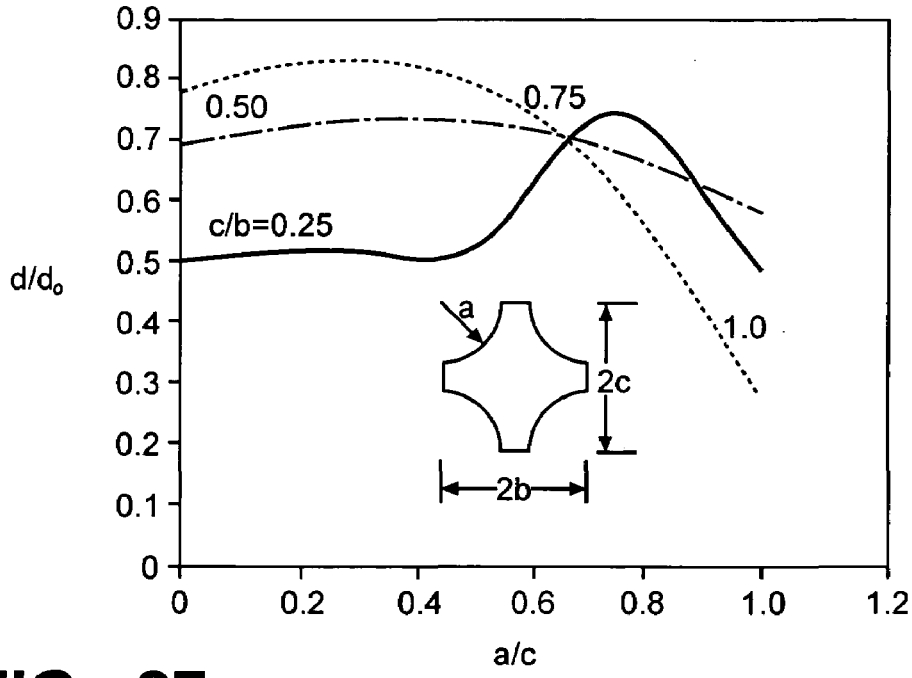
FIG. 27 is a graph illustrating the relationship among the ratio of the corner radius "a" to half-height "c", the ratio of the height "2c" to the base "2b" of a rectangular flow passage with rounded corners and the ratio of the optimal hydraulic diameter "d" of a rectangular passage with rounded corners to the optimal hydraulic diameter "$d_o$" of a circular passage.
Figure 28:
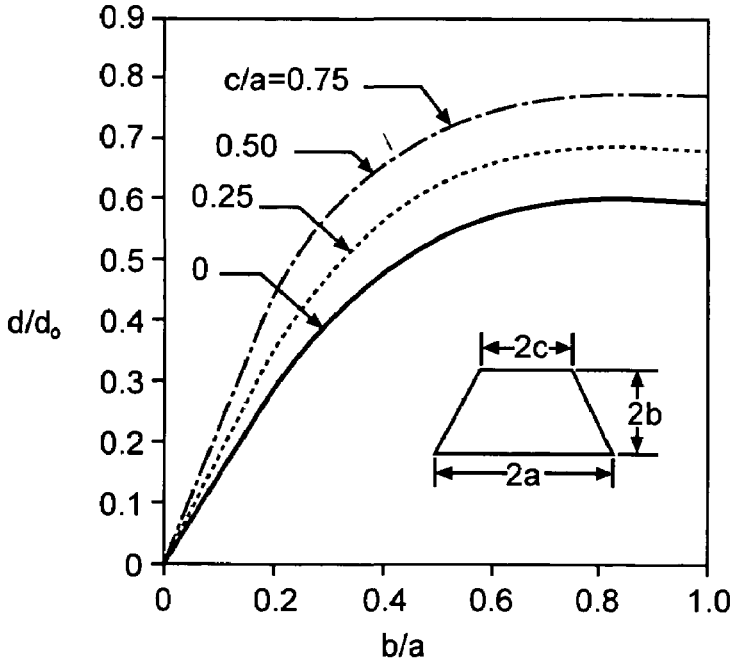
FIG. 28 is a graph illustrating the relationship among the ratio of the height "2b" to the base "2a", the ratio of the top "2c" to the base "2b" of a trapezoidal flow passage and the ratio of the optimal hydraulic diameter "d" of a trapezoidal passage to the optimal hydraulic diameter "$d_o$" of a circular passage.
Figure 29:
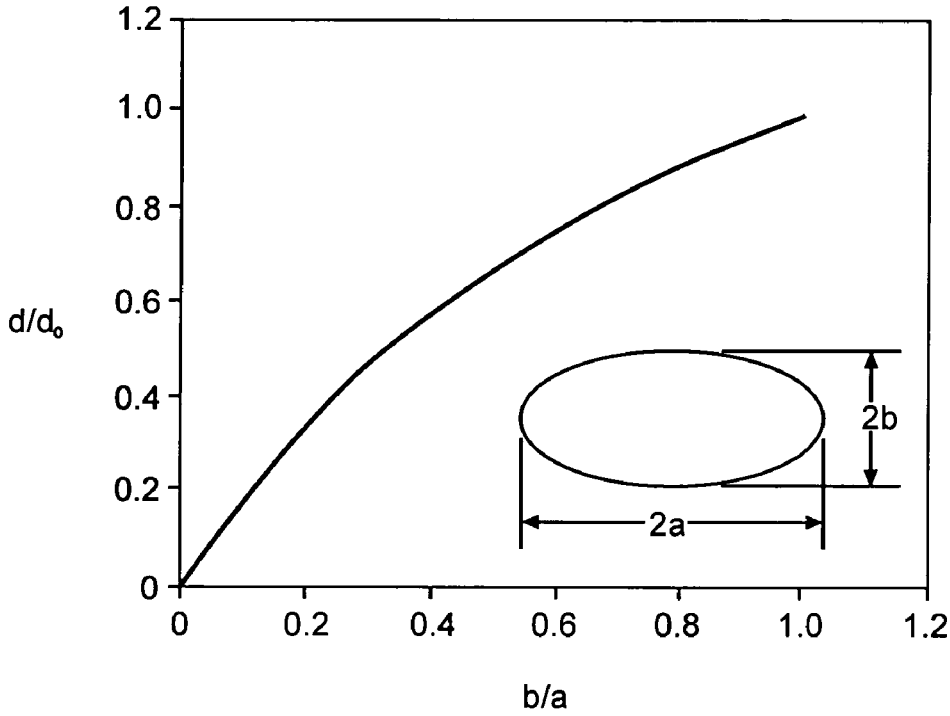
FIG. 29 is a graph illustrating the relationship between the ratio of the semi-minor axis "b" to the semi-major axis "a" of an elliptical flow passage and the ratio of the optimal hydraulic diameter "d" of an elliptical flow passage to the optimal hydraulic diameter "$d_o$" of a circular flow passage.
Figure 30:
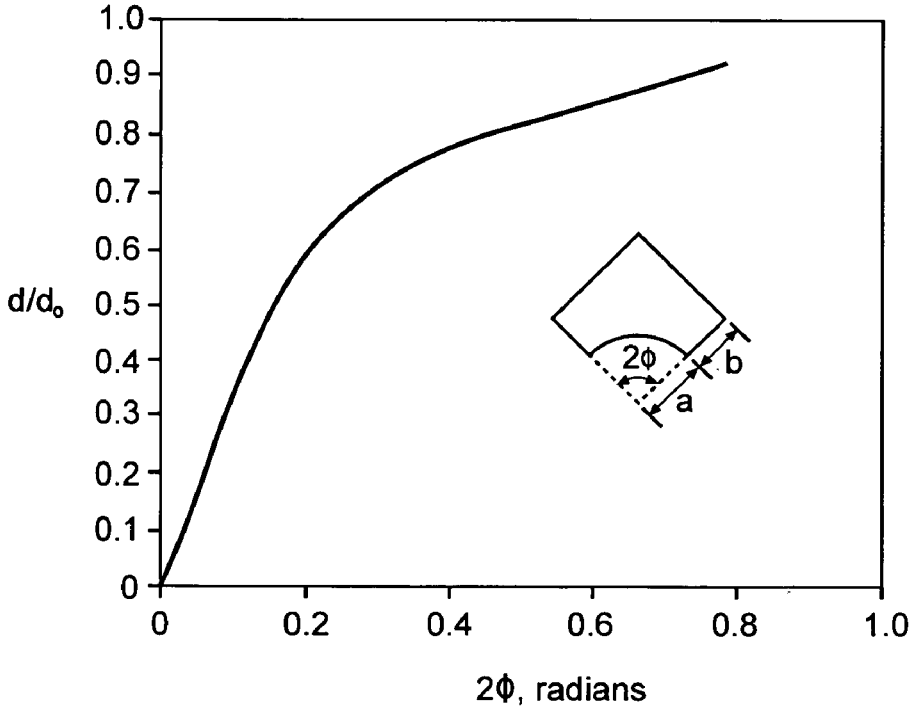
FIG. 30 is a graph illustrating the relationship between the included angle "2ϕ" of a "boomerang" shaped flow passage and the ratio of the optimal hydraulic diameter "d" of a "boomerang" shaped flow passage to the optimal hydraulic diameter "$d_o$" of a circular flow passage.
Figure 31:
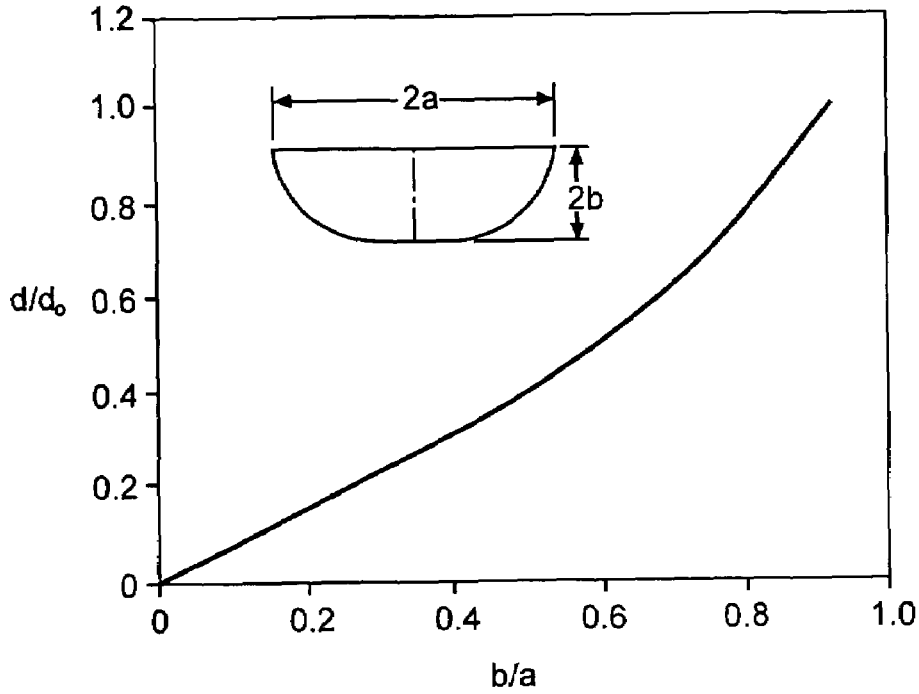
FIG. 31 is a graph illustrating the relationship between the ratio of the semi-minor axis "b" to the semi-major axis "a" of a semi-elliptical flow passage and the ratio of the optimal hydraulic diameter "d" of a semi-elliptical flow passage to the optimal hydraulic diameter "$d_o$" of a circular flow passage.
Figure 32:
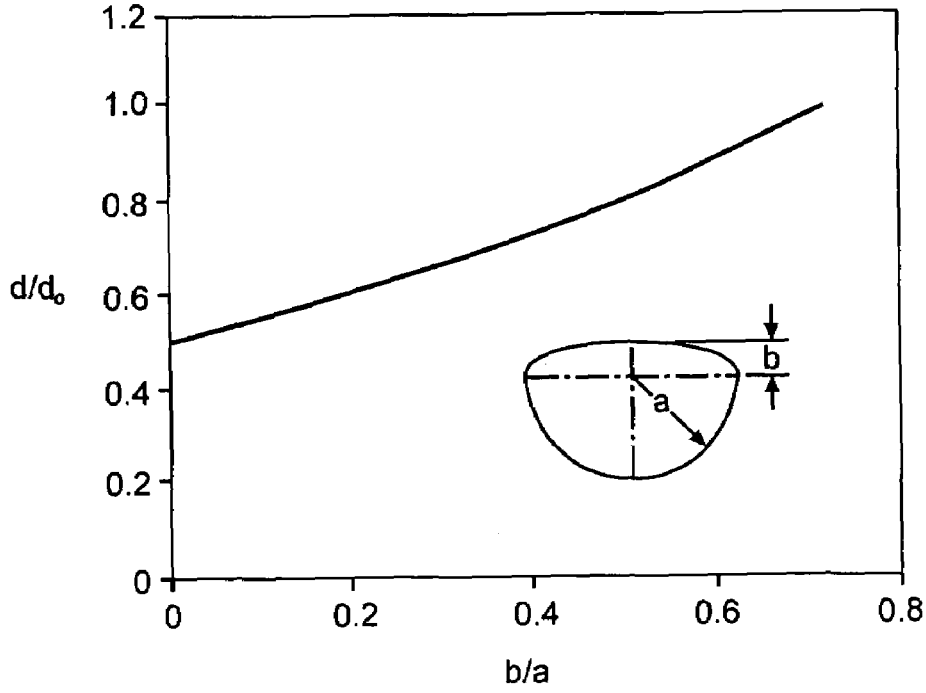
FIG. 32 is a graph illustrating the relationship between the ratio of minor radius "b" to the major radius "a" of an elliptic-cum-circular flow passage and the ratio of the optimal hydraulic diameter "d" of an elliptic-cum-circular flow passage to the optimal hydraulic diameter "$d_o$" of a circular flow passage.
Figure 33:
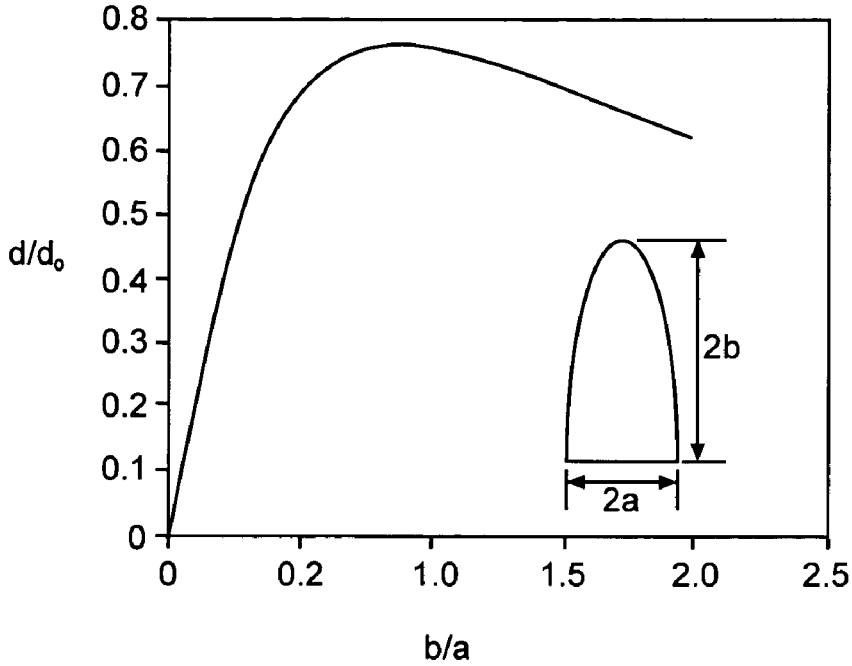
FIG. 33 is a graph illustrating the relationship between the ratio of the height "2b" to the base "2a" of a parabolic flow passage and the ratio of the optimal hydraulic diameter "d" of a parabolic flow passage to the optimal hydraulic diameter "$d_o$" of a circular flow passage.
Figure 34:
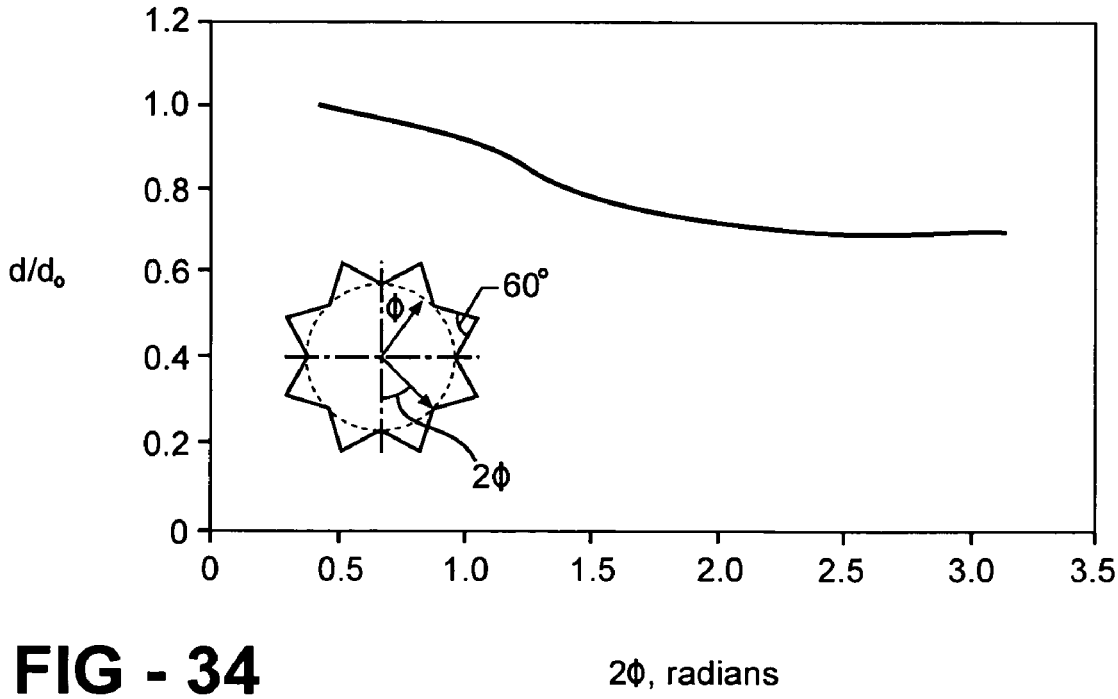
FIG. 34 is a graph illustrating the relationship between the included angle "2ϕ" of a multi-point star passage and the ratio of the optimal hydraulic diameter "d" of a multi-point star flow passage to the optimal hydraulic diameter "$d_o$" of a circular flow passage.

Another example presented below illustrates the manner in which the optimal hydraulic diameter "d" of a noncircular passage, such as a hypocycloidal passage shown in FIG. 22, is determined when the optimal hydraulic diameter "$d_o$" of a baseline circular passage is known. As is recognized by those skilled in the art, a hypocycloid is described by a point on the periphery of a circle having a radius "b" rolling inside a fixed circle having a radius "a".

Referring to FIG. 22, values of the ratio "$d/d_o$" for respective members of a family of hypocycloidal passages are shown. The graph set forth in FIG. 22 also illustrates the extent to which the value of "$d/d_o$" varies with the number of sides "n" of a given hypocycloidal passage. The values of "$d/d_o$" plotted in FIG. 22 as a function of the number of sides "n" of the hypocycloidal passages, are also set forth in column 2 of Table 4.

TABLE 4

Calculation of the Optimal Hydraulic Diameter d of Hypocycloidal Passages utilizing R-134a Refrigerant

| n | $d/d_o$ | d, in. (mm) |
|---|---|---|
| 3 | 0.3084 | 0.0123(0.3084) |
| 4 | 0.4112 | 0.0164(0.4112) |
| 5 | 0.4626 | 0.0185(0.4626) |
| 6 | 0.4935 | 0.0197(0.4935) |
| 7 | 0.5141 | 0.0206(0.5141) |
| 8 | 0.5287 | 0.0211(0.5287) |
| 9 | 0.5397 | 0.0216(0.5397) |
| 10 | 0.5483 | 0.0219(0.5483) |

Assume that the operating conditions of an evaporator utilizing tubes incorporating the hypocycloidal flow passages are identical to those of the evaporator described above in Table 2 and in paragraphs following Table 2. Thus, under these conditions the optimal hydraulic diameter "$d_o$" of the baseline circular passage can be taken as 0.040 in (1 mm) as computed above with the use of Equation (1). Given this value of "$d_o$" and the values of the ratio "$d/d_o$" for the respective hypocycloidal passages in the graph of FIG. 21 as well as in column 2 of Table 4, the optimal hydraulic diameter "d" for each of the hypocycloidal passages can be calculated. The calculated values are set forth in column 3 of Table 4.

Comparison of the data set forth in Tables 3 and 4 reveals that the optimal hydraulic diameter "$d_o$" of a circular passage calculated for a given refrigerant under a given set of operating conditions is always greater than the optimal hydraulic diameter "d" of any non-circular passage, such as a cusped passage or a hypocycloidal passage, under identical operating conditions. Furthermore, although the cusped and hypocycloidal passages are similar in shape, the magnitudes of the optimal hydraulic diameters "d" of the two types of passages are quite different. This underscores the need to establish the optimal hydraulic diameter for each flow passage to be utilized in a heat exchanger of the present invention.

The optimal hydraulic diameter is highly passage-specific and there is no universal value of the optimal hydraulic diameter applicable to all circular and noncircular passages.

According to the teachings of the subject invention, the optimal hydraulic diameter ratios $d/d_o$ were determined for a number of flow passages of interest as shown in FIGS. 20 through 34. Presented in Table 5 is a summary of the passage-specific optimal hydraulic diameter ratios "$d/d_o$" together with the appropriate geometric parameter ranges for the flow passages shown in FIGS. 20 through 34.

TABLE 5

Summary of the Passage-Specific Hydraulic Diameter Ratios and Geometric Parameters for Some Flow Passages

| Flow Passage shape | Optimal Diameter Ratio $d/d_o$ | Geometric Parameter Range | Reference FIG. |
|---|---|---|---|
| Polygon | 0.6–1.0 | $3 \leqq n \leqq \infty$ | 20 |
| Cusp | 0–0.35 | $2 \leqq n \leqq \infty$ | 21 |
| Hypocycloid | 0–0.55 | $2 \leqq n \leqq \infty$ | 22 |
| Isosceles triangle | 0–0.6 | $0 \leqq b/a \leqq 1$ | 23 |
| Equilateral triangle with rounded corners | 0.2–0.8 | $0 \leqq a/b \leqq 1$ | 24 |
| Four-point star | 0–0.75 | $0.75 \leqq \phi \leqq 1.50$ | 25 |
| Rectangle | 0–0.8 | $0 \leqq b/a \leqq 1$ | 26 |
| Rectangle with rounded corners | 0.45–0.85 | $0 \leqq a/c \leqq 1$<br>$0.25 \leqq c/b \leqq 0.75$ | 27 |
| Trapezium | 0–0.8 | $0 \leqq b/a \leqq 1$<br>$0 \leqq c/a \leqq 0.8$ | 28 |
| Ellipse | 0–1 | $0 \leqq b/a \leqq 1$ | 29 |
| Boomerang | 0–0.9 | $0 \leqq 2\phi \leqq 0.8$ | 30 |
| Semi-ellipse | 0–1 | $0 \leqq b/a \leqq 0.9$ | 31 |
| Ellipse-cum-circle | 0.5–1 | $0 \leqq b/a \leqq 0.7$ | 32 |
| Parabola | 0–0.75 | $0 \leqq b/a \leqq 2$ | 33 |
| Multi-point star | 0.6–1 | $0.5 \leqq 2\phi \leqq 3$ | 34 |

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A heat exchanger of the type wherein an upstream to downstream flow of a fluid is directed over its external surface for inducing a transfer of thermal energy between an external fluid and a refrigerant circulating within said heat exchanger, said heat exchanger comprising;

a pair of spaced tanks;

a pair of slotted headers;

a plurality of flow separators within said tanks to induce multiple passes of said refrigerant circulating within said heat exchanger;

an inlet tube attached to said one spaced tank;

an outlet tube attached to said one spaced tank;

a pair of reinforcement plates;

a plurality of heat exchange tubes extending between said tanks and in fluid communication therewith;

a plurality of flow passages within said tubes having at least one corner having an included angle of less than ninety degrees and formed by a pair of straight or arcuate first side and a second side and wherein said flow passage is of a shape selected from at least one of rectangular with rectangularly or circularly indented corners, triangular with rectangular or circular indentations, circular with rectangular or circular indentations, and elliptical with rectangular or circular indentations; and a plurality of convoluted fins positioned in alternating relation between said tubes constrained by said pair of slotted headers and said pair of reinforcement plates.

2. A heat exchanger as recited in claim 1 wherein said flow passage includes a passage-specific optimal hydraulic diameter, d, determined by a relationship between a cross-sectional configuration of the flow passage and an optimal hydraulic diameter, $d_o$, of a baseline circular passage given by the relationship $$d_o = \frac{\dot{m}\Phi}{\mu}$$

wherein, $d_o$ is the baseline optimal hydraulic diameter of the baseline circular passage cross-sectional area expressed in ft or in m, $\mu$ is the dynamic viscosity of a saturated liquid-vapor mixture circulating in said heat exchanger expressed in $lb_m$/ft·hr or in Pa·s, $\dot{m}$ is the mass flow rate of the refrigerant through the baseline circular passage expressed in $lb_m$/hr or in kg/s, $\Phi$ is a dimensionless flow parameter dependent on the dimensionless property parameter, Prandtl number Pr, defined as $$Pr = \frac{\mu c_p}{k}$$

wherein $\mu$ is the dynamic viscosity of a saturated liquid-vapor mixture expressed in $lb_m$/ft·hr or in Pa·s, $c_p$ is the isobaric specific heat of the saturated liquid-vapor mixture expressed in Btu/$lb_m$·° F. or in kJ/kg·K, k is the thermal conductivity of the saturated liquid-vapor mixture expressed in Btu/ft·hr·° F. or in W/m·K.

3. A heat exchanger as recited in claim 2 wherein said flow passage is an equilateral triangle with indented rounded corners with the ratio of its optimal hydraulic diameter "d" to the optimal hydraulic diameter "$d_o$" of said baseline circular flow passage in the range of $0.2 \leqq d/d_o \leqq 0.8$ corresponding to the ratio of the corner radius "a" to the half-side "b" of the equilateral triangle in the range of $0 \leqq a/b \leqq 1$.

4. A heat exchanger as recited in claim 2 wherein said flow passage is a rectangle with indented rounded corners with the ratio of its optimal hydraulic diameter "d" to the optimal hydraulic diameter "$d_o$" of said baseline circular flow passage in the range of $0.45 \leqq d/d_o \leqq 0.85$ corresponding to the ratio of the corner radius "a" to half-height "c" in the range of $0 \leqq a/c \leqq 1$ and the ratio of half-height "c" to half-base "b" in the range of $0.25 \leqq c/b \leqq 0.75$.

5. A heat exchanger as recited in claim 2 wherein said flow passage is boomerang-shaped with the ratio of its optimal hydraulic diameter "d" to the optimal hydraulic diameter "$d_o$" of said baseline circular flow passage in the range of $0 \leqq d/d_o \leqq 0.9$ corresponding to the included angle "$2\phi$" of the boomerang sides expressed in radians in the range of $0 \leqq 2\phi \leqq 0.8$.

6. A heat exchanger as recited in claim 1 and including a fluid inlet tube and a fluid outlet tube in fluid communication with said tanks comprising at least one flow separator to divide the flow into a multiple number of flow passes (P2, P3, P4, etcetera) with each pass comprising a varying number of tubes.

7. A heat exchanger as recited in claim 6 wherein the optimum number of tubes in each of said flow pass within said heat exchanger is determined in accordance with the ratios of the optimal number of tubes in each of said pass to the total number of tubes in said heat exchanger as set forth in Table 1 wherein the numerical values (2 through 10) in Row 1 indicate the number of flow passes (P2, P3, P4, etcetera) within said heat exchanger and the values in Rows 2–11 represent the ratio of the optimal number of tubes in each increasing flow pass.

TABLE 1

Optimal Tube Ratios for Each Pass of a Multi-Pass Evaporator

| 2 | 3 | 4 | 5 | 6 | 7 | 8 | 9 | 10 |
|---|---|---|---|---|---|---|---|---|
| 0.3981 | 0.2764 | 0.2153 | 0.1769 | 0.1503 | 0.1306 | 0.1155 | 0.1036 | 0.0939 |
| 0.6019 | 0.3333 | 0.2384 | 0.1885 | 0.1568 | 0.1347 | 0.1182 | 0.1055 | 0.0952 |
| | 0.3903 | 0.2616 | 0.2000 | 0.1634 | 0.1388 | 0.1209 | 0.1073 | 0.0966 |
| | | 0.2847 | 0.2115 | 0.1699 | 0.1429 | 0.1236 | 0.1092 | 0.0980 |
| | | | 0.2231 | 0.1765 | 0.1469 | 0.1264 | 0.1111 | 0.0993 |
| | | | | 0.1831 | 0.1510 | 0.1291 | 0.1130 | 0.1007 |
| | | | | | 0.1551 | 0.1318 | 0.1149 | 0.1020 |
| | | | | | | 0.1345 | 0.1168 | 0.1034 |
| | | | | | | | 0.1186 | 0.1048 |
| | | | | | | | | 0.1061 |

8. A method of maximizing heat transfer and minimizing pressure drop of a heat exchanger having at least one tube defining a plurality of flow passages and having a refrigerant circulating therein, the method comprising:

determining a Prandtl number, Pr, for a desired refrigerant;

determining a dimensionless flow parameter, Φ, for a baseline circular flow passage corresponding to Pr for the desired refrigerant;

determining an optimal hydraulic diameter of a baseline circular flow passage, $d_o$, expressed in feet or meters according to the following relationship $$d_o = \frac{\dot{m}\Phi}{\mu}$$

wherein μ is the dynamic viscosity of a saturated liquid-vapor mixture of the desired refrigerant circulating in the heat exchanger, and $\dot{m}$ is the mass flow rate of the desired refrigerant through the baseline circular passage;

providing the flow passages having a non-circular cross-sectional configuration;

determining a passage-specific optimal hydraulic diameter, d, based upon the relationship between the cross-sectional configuration of the flow passages and $d_o$; and providing the heat exchanger with the plurality of flow passages having the passage-specific optimal hydraulic diameter, d, to maximize heat transfer therebetween and to minimize pressure drop therein.

9. A method as set forth in claim 8 wherein the dimensionless flow parameter is from the range of 0 to about 0.001 for a corresponding Prandtl number of from 0 to about 50.

10. A method as set forth in claim 8 wherein determining the passage-specific optimal hydraulic diameter is further defined as determining a ratio of $d/d_o$ in the range of from about 0.1 to about 1.

11. A method as set forth in claim 8 farther comprising the step of providing a desired number of tubes having the plurality of flow passages with optimal hydraulic diameter, d, to maximize heat transfer and to minimize pressure drop.

12. A method of dimensioning a flow passage having a non-circular cross-sectional configuration of a tube for a heat exchanger having a refrigerant circulating therein, said method comprising:

determining a Prandtl number, Pr, for a desired refrigerant of from 0 to about 50;

determining a dimensionless flow parameter, Φ, for a baseline circular flow passage of from 0 to about 0.001 corresponding to Pr for the desired refrigerant;

determining an optimal hydraulic diameter of a baseline circular flow passage, $d_o$, expressed in feet or meters according to the following relationship $$d_o = \frac{\dot{m}\Phi}{\mu}$$

wherein μ is the dynamic viscosity of a saturated liquid-vapor mixture of the desired refrigerant circulating in the heat exchanger, and $\dot{m}$ is the mass flow rate of the desired refrigerant through the baseline circular passage;

determining a passage-specific optimal hydraulic diameter, d, for the flow passage based upon the relationship between the cross-sectional configuration and $d_o$;

determining a number of flow passages with the passage-specific optimal hydraulic diameter to maximize heat transfer therebetween and to minimize pressure drop therein; and providing a tube having the number of flow passages with the passage-specific optimal hydraulic diameter.

13. A method as set forth in claim 12 wherein determining the passage-specific optimal hydraulic diameter is further defined as determining a ratio of $d/d_o$ in the range of from about 0.1 to about 1.

14. A method as set forth in claim 12 further comprising the step of determining an number of tubes to maximize heat transfer of the heat exchanger and forming the heat exchanger with the number of tubes.

15. A heat exchanger having a desired refrigerant circulating therein, said heat exchanger comprising;

a pair of spaced tanks;

a pair of slotted headers;

a plurality of flow separators within said tanks to induce multiple passes of said refrigerant circulating within said heat exchanger;

an inlet tube attached to said one spaced tank;

an outlet tube attached to said one spaced tank;

a pair of reinforcement plates;

a plurality of heat exchange tubes extending between said tanks and in fluid communication therewith;

a plurality of flow passages having a non-circular cross-sectional configuration and having a passage-specific optimal hydraulic diameter, d, based upon the relationship between the cross-sectional configuration and an optimal hydraulic diameter of a baseline circular flow passage, $d_o$;

wherein $d_o$ is expressed in feet or meters according to the following relationship $$d_o = \frac{\dot{m}\Phi}{\mu}$$

wherein μ is the dynamic viscosity of a saturated liquid-vapor mixture of the desired refrigerant circulating in the heat exchanger, and $\dot{m}$ is the mass flow rate of the desired refrigerant through the baseline circular passage, and Φ is a dimensionless flow parameter for the baseline circular flow passage that corresponds to a Prandtl number, Pr, for the desired refrigerant; and a plurality of convoluted fins positioned in alternating relation between said tubes constrained by said pair of slotted headers and said pair of reinforcement plates.

16. A heat exchanger as set forth in claim 15 wherein the dimensionless flow parameter is from the range of 0 to about 0.001 for a corresponding Prandtl number of from 0 to about 50.

17. A heat exchanger as set forth in claim 15 wherein determining the passage-specific optimal hydraulic diameter is further defined as determining a ratio of $d/d_o$ in the range of from about 0.1 to about 1.

18. A heat exchanger as set forth claim 15 further comprising at least one flow separator to divide the flow into a multiple number of flow passes (P2, P3, P4, et cetera) with each pass comprising a varying number of tubes.

19. A heat exchanger as set forth in claim 18 wherein the optimum number of tubes in each of said flow pass within said heat exchanger is determined in accordance with the ratios of the optimal number of tubes in each of said pass to the total number of tubes in said heat exchanger as set forth in Table 1 wherein the numerical values (2 through 10) in Row 1 indicate the number of flow passes (P2, P3, P4, etcetera) within said heat exchanger and the values in Rows 2–11 represent the ratio of the optimal number of tubes in each increasing flow pass.

TABLE 1

| Optimal Tube Ratios for Each Pass of a Multi-Pass Evaporator | | | | | | | | |
|---|---|---|---|---|---|---|---|---|
| 2 | 3 | 4 | 5 | 6 | 7 | 8 | 9 | 10 |
| 0.3981 | 0.2764 | 0.2153 | 0.1769 | 0.1503 | 0.1306 | 0.1155 | 0.1036 | 0.0939 |
| 0.6019 | 0.3333 | 0.2384 | 0.1885 | 0.1568 | 0.1347 | 0.1182 | 0.1055 | 0.0952 |
| | 0.3903 | 0.2616 | 0.2000 | 0.1634 | 0.1388 | 0.1209 | 0.1073 | 0.0966 |
| | | 0.2847 | 0.2115 | 0.1699 | 0.1429 | 0.1236 | 0.1092 | 0.0980 |
| | | | 0.2231 | 0.1765 | 0.1469 | 0.1264 | 0.1111 | 0.0993 |
| | | | | 0.1831 | 0.1510 | 0.1291 | 0.1130 | 0.1007 |
| | | | | | 0.1551 | 0.1318 | 0.1149 | 0.1020 |
| | | | | | | 0.1345 | 0.1168 | 0.1034 |
| | | | | | | | 0.1186 | 0.1048 |
| | | | | | | | | 0.1061 |

* * * * *